US012246212B2

(12) United States Patent
Abrams-Harbour et al.

(10) Patent No.: US 12,246,212 B2
(45) Date of Patent: Mar. 11, 2025

(54) CORE BLADDER AND ASSEMBLY INCLUDING THE SAME

(71) Applicant: Town Strength, LLC, Boulder, CO (US)

(72) Inventors: Karen Abrams-Harbour, Boulder, CO (US); Scott Davis, Grass Valley, CA (US)

(73) Assignee: Town Strength, LLC, Boulder, CO (US)

( * ) Notice: Subject to any disclaimer, the term of this patent is extended or adjusted under 35 U.S.C. 154(b) by 247 days.

(21) Appl. No.: 17/953,171

(22) Filed: Sep. 26, 2022

(65) Prior Publication Data

US 2024/0100388 A1 Mar. 28, 2024

(51) Int. Cl.

| | |
|---|---|
| ***A63B 21/00*** | (2006.01) |
| ***A63B 22/16*** | (2006.01) |
| ***A63B 23/02*** | (2006.01) |

(52) U.S. Cl.

CPC ..... *A63B 21/4033* (2015.10); *A63B 22/16* (2013.01); *A63B 23/0205* (2013.01); *A63B 2225/62* (2013.01)

(58) Field of Classification Search

CPC ..... A63B 21/0602; A63B 26/003; A63B 22/14–16; A63B 41/00–125

See application file for complete search history.

(56) References Cited

U.S. PATENT DOCUMENTS

| | | | | |
|---|---|---|---|---|
| 2,991,589 | A | 7/1961 | Ayala | |
| 5,050,870 | A * | 9/1991 | Pollock | A63B 21/065 482/44 |
| 5,085,320 | A | 2/1992 | Scott | |
| 5,839,577 | A | 11/1998 | Friedler | |
| 5,997,422 | A | 12/1999 | Cooper | |
| 6,398,677 | B1 | 6/2002 | Hergert et al. | |
| 6,554,753 | B1 | 4/2003 | Weck et al. | |
| 6,575,885 | B1 | 6/2003 | Weck et al. | |
| 6,688,998 | B2 | 2/2004 | Hergert et al. | |
| 6,712,745 | B1 | 3/2004 | Lynne | |
| D507,311 | S | 7/2005 | Butler et al. | |
| D507,608 | S | 7/2005 | Chen | |
| 6,945,919 | B2 | 9/2005 | Yang | |

(Continued)

FOREIGN PATENT DOCUMENTS

| | | |
|---|---|---|
| DE | 29922174 U1 | 2/2000 |
| DE | 20315113 U1 | 12/2003 |

(Continued)

OTHER PUBLICATIONS

International Search Report and Written Opinion issued in Application No. PCT/US2023/074819 dated Jan. 11, 2024, 13 pages.

*Primary Examiner* — Nyca T Nguyen

(74) *Attorney, Agent, or Firm* — Honigman LLP

(57) ABSTRACT

A core bladder is disclosed. The core bladder a body, a skeletal load-support matrix, and a valve. The body defines a fluid-receiving cavity. The skeletal load-support matrix is disposed within the fluid-receiving cavity. The valve is supported by the body. The valve is configured to permit fluid communication with the fluid-receiving cavity to selectively arrange the body in one of a compact deflated state and an expanded inflated state. An exercise assembly including the core bladder is also disclosed.

10 Claims, 14 Drawing Sheets

(56) References Cited

U.S. PATENT DOCUMENTS 7,004,886 B2 2/2006 Chen
D546,907 S 7/2007 Dykgraaf et al.
7,344,488 B2 3/2008 Weck et al.
7,462,142 B1 * 12/2008 Gordon ..... A63B 21/4037 482/142
7,494,446 B2 2/2009 Weck et al.
7,618,358 B2 11/2009 Traub et al.
D649,206 S 11/2011 Kossman
8,272,980 B1 9/2012 Johnson
D683,538 S 6/2013 Kossman
8,727,951 B2 * 5/2014 Jones ..... A63B 21/4035 482/109
D724,162 S 3/2015 James
D749,682 S 2/2016 Thomason et al.
9,314,118 B2 * 4/2016 Blazar ..... A47G 9/1027
9,320,940 B2 4/2016 Rainey
9,403,055 B2 8/2016 Alessandri et al.
D771,378 S 11/2016 Burrington
D819,824 S 6/2018 Moehlenbrock
9,999,807 B2 6/2018 Rainey
10,029,155 B1 * 7/2018 Lo ..... A63B 41/02
10,322,311 B2 6/2019 Naomi
10,486,034 B2 11/2019 Ha
10,500,130 B2 12/2019 Cox et al.
11,160,725 B2 11/2021 Pasquale et al.
11,207,566 B2 12/2021 Lin
11,707,661 B1 * 7/2023 Magrino ..... A63B 21/0602 482/86
11,844,451 B2 * 12/2023 Pearce ..... A47G 9/0253
2004/0082445 A1 * 4/2004 Zabel ..... A63B 21/06 482/109
2008/0188360 A1 * 8/2008 Chu ..... A63B 69/222 482/83
2008/0271250 A1 * 11/2008 Poppe ..... A47C 27/05 5/645
2011/0003655 A1 * 1/2011 Chernick ..... A63B 39/00 446/491
2011/0237368 A1 * 9/2011 Lin ..... B29D 22/02 473/603
2011/0251030 A1 * 10/2011 Pfitzer ..... A63B 23/03575 482/110
2011/0275494 A1 * 11/2011 Radi ..... A63B 21/0603 482/93
2012/0139727 A1 * 6/2012 Houvener ..... A63B 71/0622 340/540
2012/0152790 A1 * 6/2012 Houvener ..... G06F 1/1626 206/521
2012/0258841 A1 10/2012 James
2013/0073064 A1 * 3/2013 Houvener ..... A63H 27/02 700/91
2013/0098364 A1 * 4/2013 Davis ..... A47G 9/10 5/636
2015/0057138 A1 2/2015 Knilans
2015/0133279 A1 * 5/2015 Alessandri ..... A47C 9/002 482/142
2017/0001060 A1 * 1/2017 D'Alesio ..... A63B 21/0602
2017/0172331 A1 6/2017 Publicover et al.
2017/0259126 A1 * 9/2017 Butt ..... A63B 45/00
2019/0076723 A1 3/2019 Cromartie
2019/0298089 A1 10/2019 Abdul
2019/0358488 A1 * 11/2019 Lu ..... A63B 22/16
2021/0060386 A1 * 3/2021 Bubyrenko ..... A63B 26/003
2021/0138287 A1 5/2021 Huting

FOREIGN PATENT DOCUMENTS

DE 202004000161 U1 4/2004
KR 20-2007-0001084 U 10/2007
WO 2007067058 A1 6/2007
WO 2015051002 A2 4/2015

* cited by examiner

CORE BLADDER AND ASSEMBLY INCLUDING THE SAME

TECHNICAL FIELD

The present disclosure relates generally to a core bladder and an assembly including the same.

BACKGROUND

This section provides background information related to the present disclosure and is not necessarily prior art. Inflatables and inflatable exercise devices are generally known, but tend to have the shortcomings that often features making them easily portable often compromise one or more of strength, compactness, and/or usability. Thus, while existing inflatables or inflatable exercise devices perform adequately for their intended purpose, improvements to inflatables are continuously being sought in order to advance the arts.

SUMMARY

This section provides a general summary of the disclosure, and is not a comprehensive disclosure of its full scope or all of its features.

One aspect of the disclosure provides a core bladder including a body, a skeletal load-support matrix, and a valve. The body defines a fluid-receiving cavity. The skeletal load-support matrix is disposed within the fluid-receiving cavity. The valve is supported by the body. The valve is configured to permit fluid communication with the fluid-receiving cavity to selectively arrange the body in one of a compact deflated state and an expanded inflated state.

Implementations of the disclosure may include one or more of the following optional features. In some implementations, the body is configured to include a dome portion and a bowl portion. The dome portion includes a curved sidewall and a substantially flat top wall. The bowl portion includes a curved sidewall and a substantially flat bottom wall. A lower edge of the curved sidewall of the dome portion is connected to an upper edge of the curved sidewall of the bowl portion.

In some examples, the skeletal load-support matrix includes a plurality of rib members extending between an inner surface of the substantially flat top wall and an inner surface of the substantially flat bottom wall. The plurality of rib members include a first rib member, a second rib member, and at least one intermediate rib member arranged between the first rib member and the second rib member. A length of one or both of the substantially flat top wall or the substantially flat bottom wall extends at least between the first rib member and the second rib member. A width of one or both of the substantially flat top wall and the substantially flat bottom wall extends at least between a first sidewall of each rib member and a second sidewall of each rib member.

In other examples, the lower edge of the curved sidewall of the dome portion defines a perimeter of the dome portion. The upper edge of the curved sidewall of the bowl portion defines a perimeter of the bowl portion. The perimeter of each of the dome portion and the bowl portion defines a substantially elliptical shape. In some instances, the body is formed of a polyurethane sheet having a thickness of about 0.5 to about 2 mm.

Another aspect of the disclosure provides an exercise assembly. The exercise assembly includes a core bladder and an outer case. The core bladder includes a sealed body supporting a valve that permits fluid communication with a fluid-receiving cavity of the sealed body for selective arrangement of the body in one of a compact deflated state or an expanded inflated state. The outer case is formed by a plurality of panels defining a core bladder receiving cavity that contains the core bladder. The outer case includes a first opening that cooperates with a closure element that provides selective access to the core bladder receiving cavity and a second opening that is sized for permitting access to the valve.

Implementations of the disclosure may include one or more of the following optional features. The core bladder includes a skeletal load-support matrix disposed within the fluid-receiving cavity. The core bladder is configured to include a dome portion and a bowl portion. The dome portion includes a curved sidewall and a substantially flat top wall. The bowl portion includes a curved sidewall and a substantially flat bottom wall. A lower edge of the curved sidewall is connected to an upper edge of the curved sidewall of the bowl portion.

In some examples, the skeletal load-support matrix includes a plurality of rib members extending between and connecting an inner surface of the substantially flat top wall and an inner surface of the substantially flat bottom wall. The plurality of rib members include a first rib member, a second end rib member, and at least one intermediate rib member between the first rib member and the second rib member.

In other examples, the plurality of panels that form the outer case includes a top panel, a bottom panel, and an intermediate panel. The top panel is configured to include a dome-shape when the core bladder is arranged in the expanded inflated state. The bottom panel is configured to include a bowl-shape when the core bladder is arranged in the expanded inflated state. The intermediate ring-shaped panel connects the dome-shaped panel to the bowl-shaped panel. The intermediate ring-shaped panel defines the first opening that provides selective access to the core bladder receiving cavity. One of the dome-shaped panel and the bowl-shaped panel defines the second opening that is sized for permitting access to the valve.

In some instances, the closure element is attached to the intermediate panel and extends over the first opening. The closure element includes a zipper having a body of material supporting cooperating teeth that are selectively joined by a slider. The top panel includes a reinforcement ring circumscribing the second opening.

In some examples, one or both of the top panel and the lower panel includes a frictional, slip-resistant portion. The frictional, slip-resistant portion includes a textured pattern optionally formed by a lightweight denier material having a urethane coating. The lightweight denier material includes ripstop nylon. The urethane coating includes polyurethane or thermoplastic polyurethane. The frictional, slip-resistant portion further includes a silicon gel pattern arranged over the lightweight denier material.

The details of one or more implementations of the disclosure are set forth in the accompanying drawings and the description below. Other aspects, features, and advantages will be apparent from the description and drawings, and from the claims.

Each of the above independent aspects of the present disclosure, and those aspects described in the detailed description below, may include any of the features, options, and possibilities set out in the present disclosure and figures, including those under the other independent aspects, and may also include any combination of any of the features, options, and possibilities set out in the present disclosure and figures.

Additional features and advantages of exemplary aspects of the disclosure will be set forth in the description which follows, and in part will be obvious from the description, or may be learned by the practice of such exemplary aspects. The features and advantages of such aspects may be realized and obtained by means of the instruments and combinations particularly pointed out in the appended claims. These and other features will become more fully apparent from the following description and appended claims or may be learned by the practice of such exemplary aspects as set forth hereinafter.

DESCRIPTION OF DRAWINGS

In order to describe the manner in which the above-recited and other advantages and features of the present disclosure can be obtained, a more particular description of the present disclosure briefly described above will be rendered by reference to specific embodiments thereof which are illustrated in the appended drawings. Understanding that these drawings depict only typical embodiments of the present disclosure and are not therefore to be considered to be limiting of its scope, the present disclosure will be described and explained with additional specificity and detail through the use of the accompanying drawings in which.

Corresponding reference numerals indicate corresponding parts throughout the drawings.

DETAILED DESCRIPTION

The present disclosure relates generally to an assembly (see, e.g., FIGS. 1-2) including an inflatable portion (see, e.g., FIGS. 3-10) removably disposable within an outer casing portion (see, e.g., FIGS. 11-14). In some instances, the assembly may be selectively arranged in: (1) an assembled-and-inflated state (see, e.g., FIG. 2) whereby the inflatable portion, while arranged in an inflated state, is disposed within the outer casing portion such that the assembly may be said to be configured in an expanded state; (2) an assembled-and-deflated state whereby the inflatable portion, while arranged in a deflated state, is disposed within the outer casing portion such that the assembly may be said to be configured in a compacted state; (3) a disassembled-and-separated state (see, e.g., FIG. 3), whereby the inflatable portion, while arranged in an inflated state, may be utilized independently of the outer casing portion; and (4) a disassembled-and-separated state (see, e.g., FIG. 11), whereby the outer casing portion may be laundered independently of the inflatable portion. Embodiments of the present disclosure provide technical solutions to a number of technical problems in the art.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
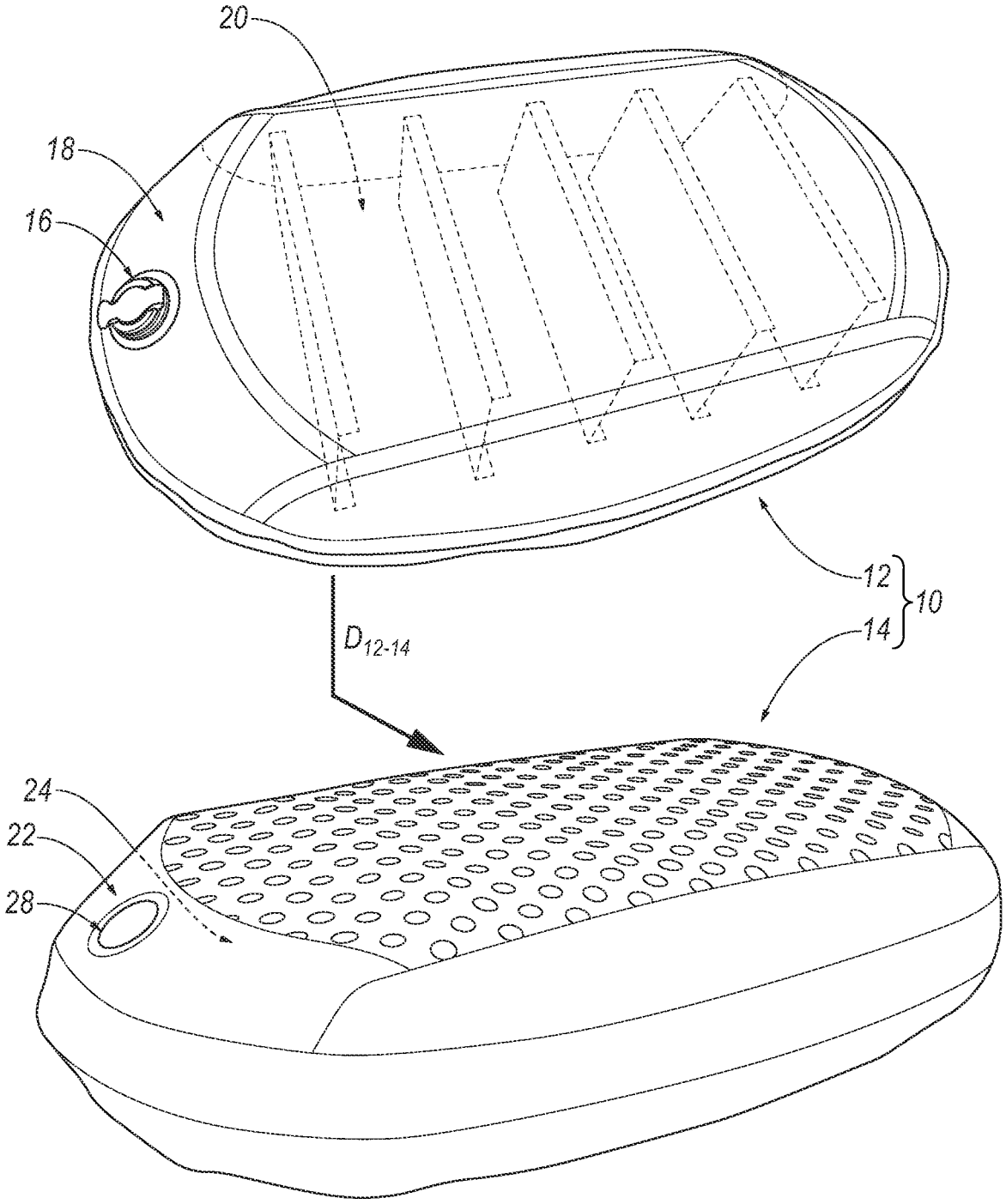
FIG. 1 is an exploded perspective view of an assembly including an inflatable portion removably disposable within an outer casing portion, according to the principles of the present disclosure.
Figure 2:
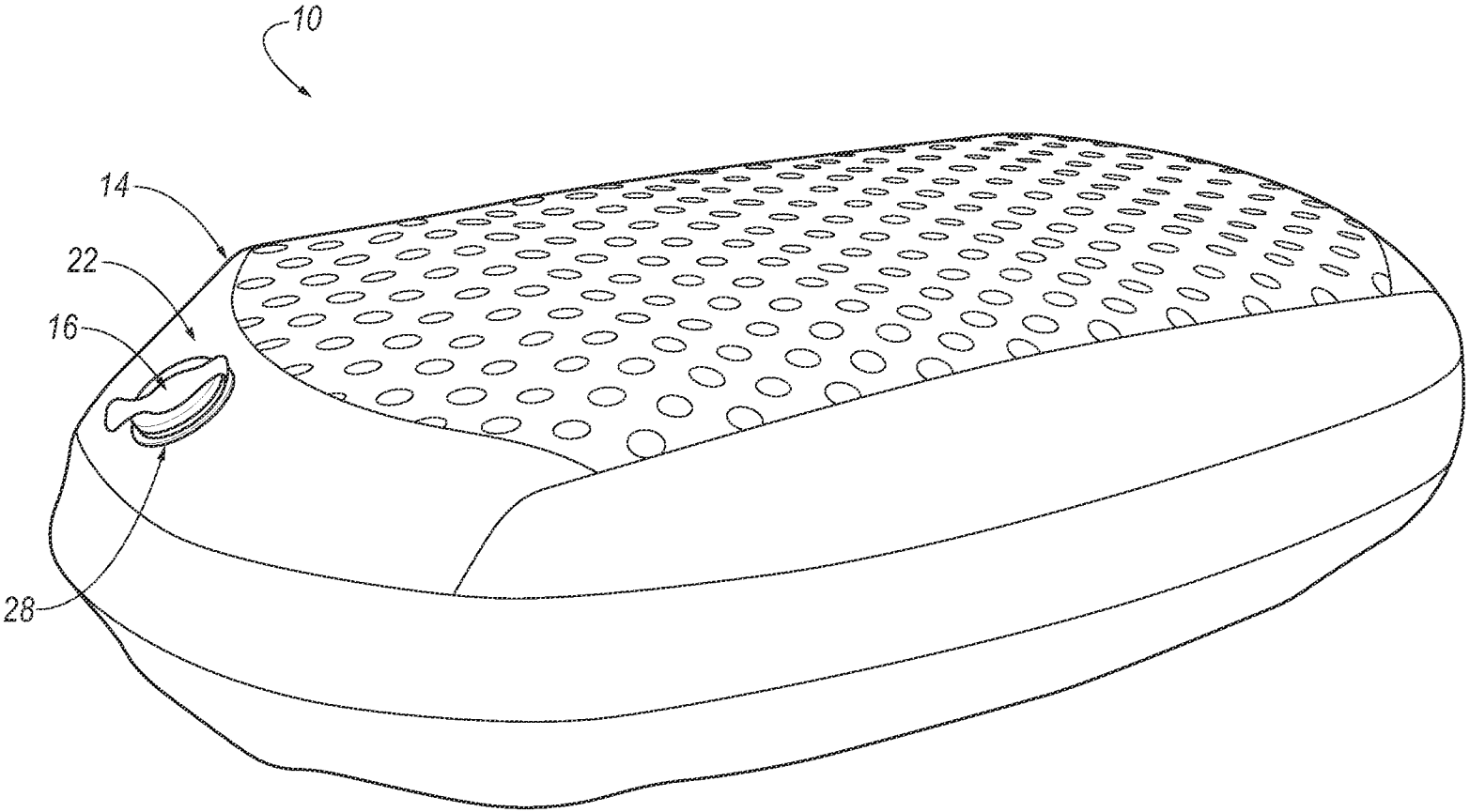
FIG. 2 is an assembled view of the assembly of FIG. 1.

With reference to FIGS. 1-2, implementations of the present disclosure relate generally to an assembly, which is shown generally at 10, components thereof, and methods of use. In some instances, the assembly 10 may be utilized as an abdominal core strength training exercise device, which may alternatively be referred to as a "stability board". As will be described in the following disclosure, the assembly 10 is sized for easy and convenient resizing (i.e., by way deflation or inflation) in order to promote deflated compact storage, inflation for use, disinfection/cleanability, and the like.

Referring to FIG. 1, in some implementations, the assembly 10 includes an inflatable portion 12 and an outer casing portion 14. The inflatable portion 12 includes a valve 16 supported by a body 18 defining a fluid-receiving cavity 20 (see also, e.g., FIGS. 7-8).

With reference to FIGS. 1-2, the outer casing portion 14 includes a body 22 defining cavity 24 (see, e.g., FIG. 1) that is sized for receiving the body 18 of the inflatable portion 12. In some configurations, the body 22 of the outer casing portion 14 may include an opening 26 (see, e.g., FIGS. 12 and 14) that permits insertion or removal of the body 18 of the inflatable portion 12 into or out of the cavity 24 of the body 22 of the outer casing portion 14. In other configurations, the body 22 of the outer casing portion 14 includes an opening 28 (see, e.g., FIGS. 1, 11, and 12) that permits, as seen at FIG. 2, access to the valve 16 of the inflatable portion 12 when the body 18 of the inflatable portion 12 is disposed within the cavity 24 of the body 22 of the outer casing portion 14.

Figure 3:
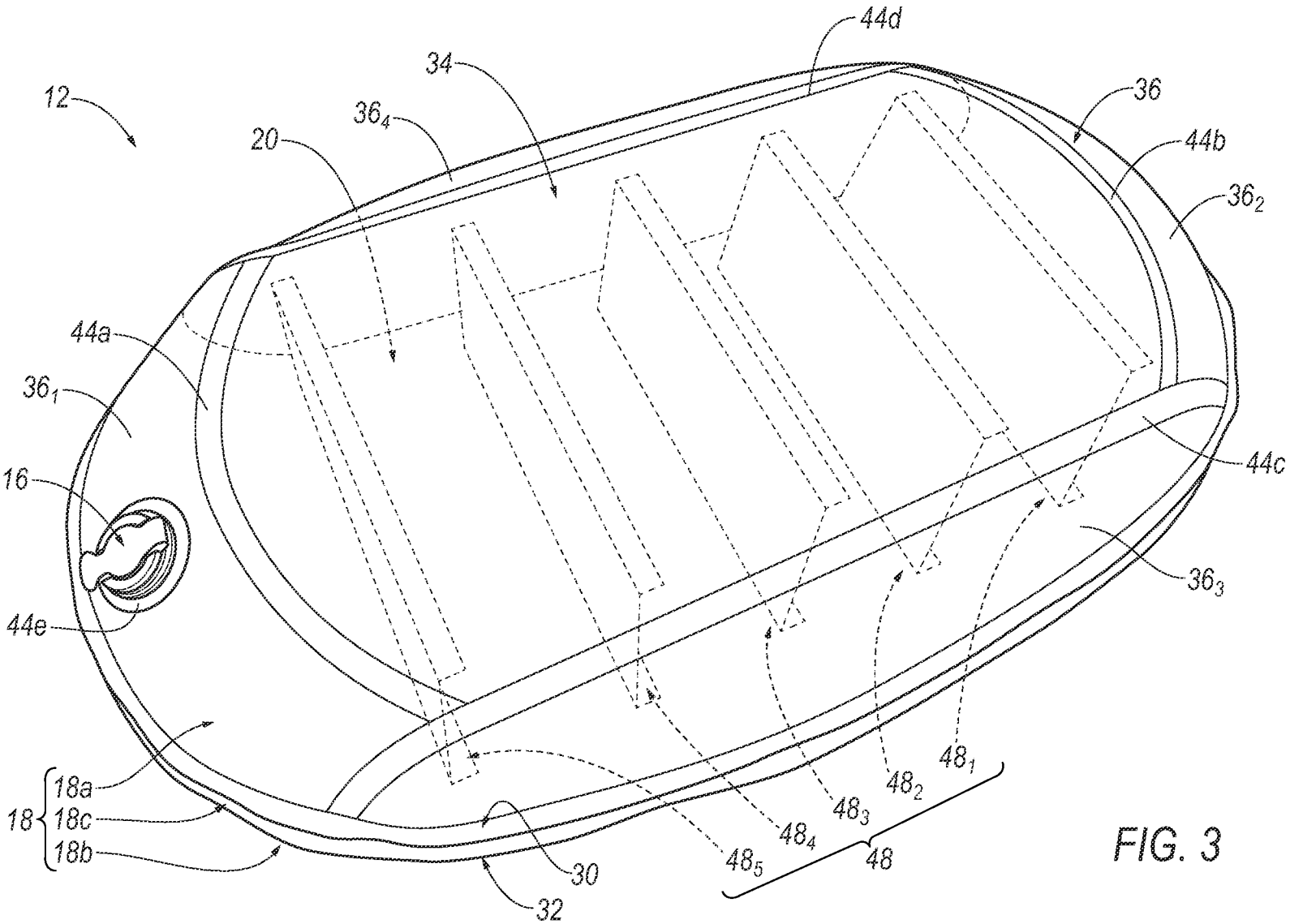
FIG. 3 is a perspective view of the inflatable portion of FIG. 1.
Figure 4:
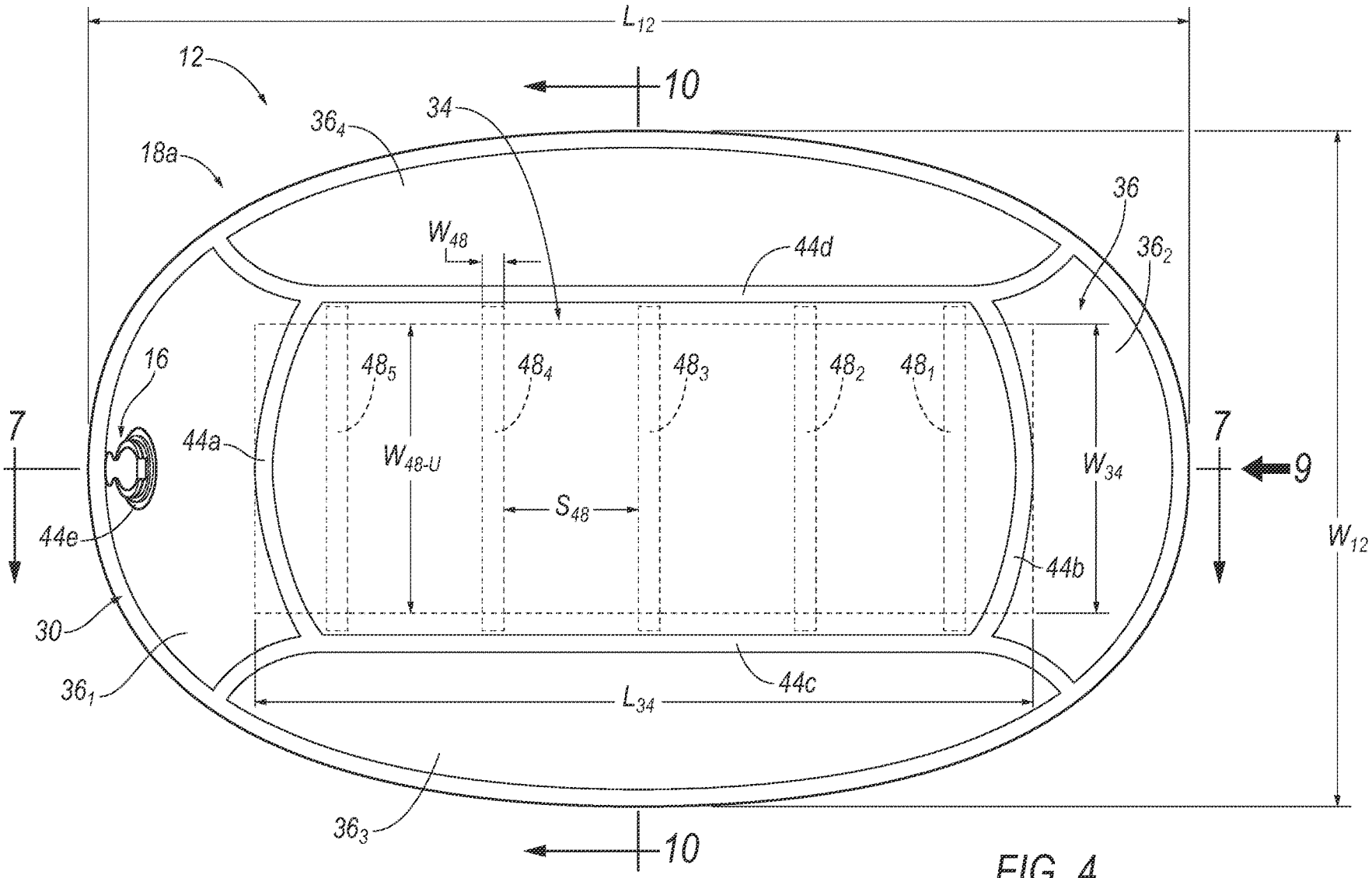
FIG. 4 is a top view of the inflatable portion of FIG. 3.
Figure 5:
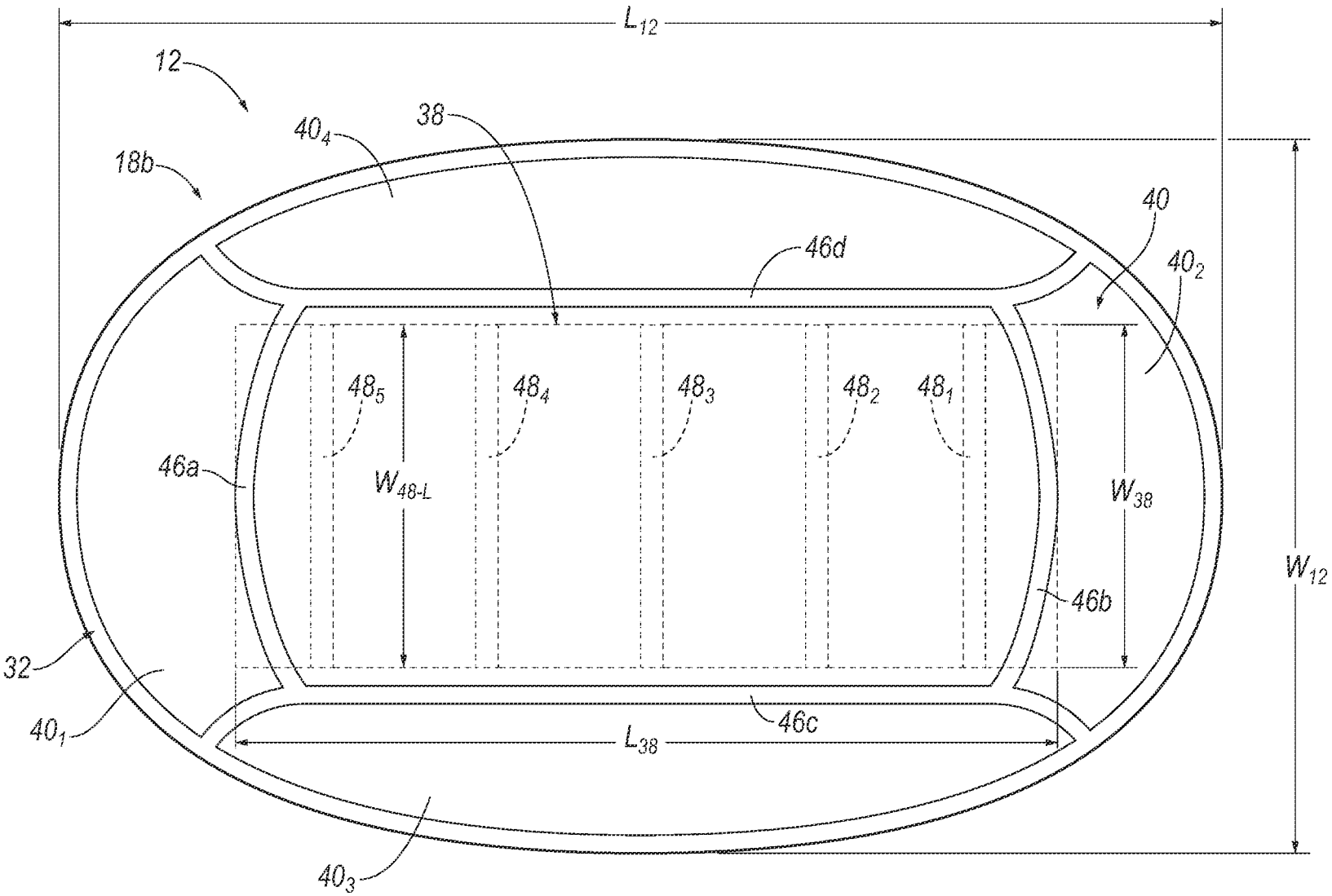
FIG. 5 is a bottom view of the inflatable portion of FIG. 3.
Figure 6:
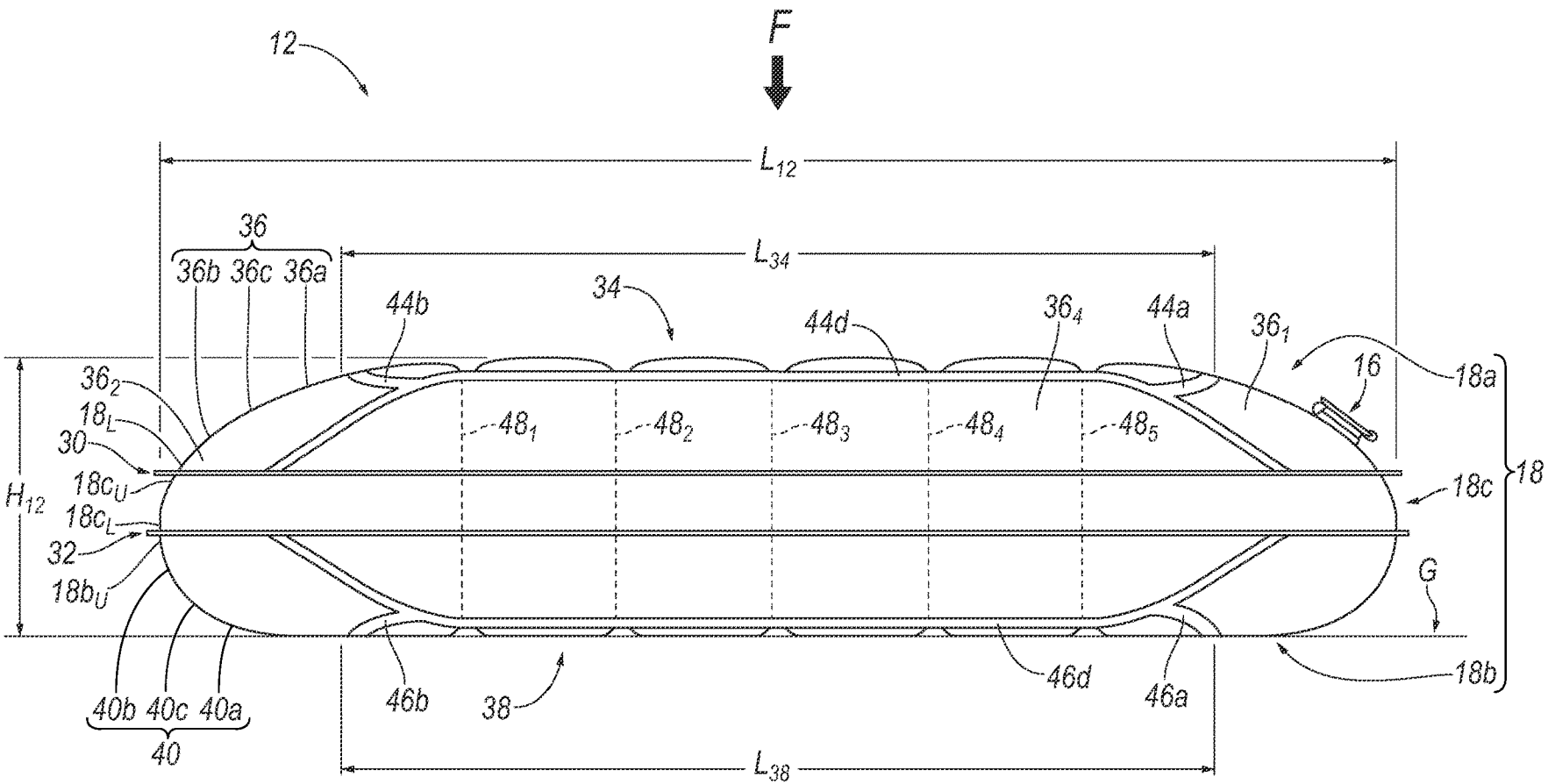
FIG. 6 is a side view of the inflatable portion of FIG. 3.

Referring to FIGS. 3-10, exemplary aspects of the inflatable portion 12 are shown. As seen at FIGS. 4 and 6, the body 18 of the inflatable portion 12 generally defines the inflatable portion 12 to include a length $L_{12}$ (see, e.g., FIGS. 4-6), width $W_{12}$ (see, e.g., 4, 5, 9), and a height $H_{12}$ (see, e.g., FIGS. 6, 7, and 9).

When the inflatable portion 12 is arranged in an inflated state, in some implementations and while the dimensions are not critical, the length $L_{12}$ of the inflatable portion 12 may be approximately equal to 60.0 to 70.0 centimeters (cm). In other implementations, when the inflatable portion 12 is arranged in an inflated state, the width $W_{12}$ of the inflatable portion 12 may be approximately equal to 30.0 to 50.0 centimeters (cm). In further implementations, when the inflatable portion 12 is arranged in an inflated state, the height $H_{12}$ of the inflatable portion 12 may be approximately equal to 10.0 to 20.0 centimeters (cm). Accordingly, a ratio of the inflated state length $L_{12}$ of the inflatable portion 12 to the inflated state width $W_{12}$ of the inflatable portion 12 may be approximately 1.0:1.6. Furthermore, a ratio of the inflated state length $L_{12}$ of the inflatable portion 12 to the inflated state height $H_{12}$ of the inflatable portion 12 may be approximately 1.0:4.6. In other words, in some configurations, when the inflatable portion 12 is arranged in an inflated-and-at-rest orientation with no external forces being applied thereto from surrounding atmosphere A (see, e.g., FIGS. 7-8), the inflatable portion 12 may define a generally rectangular cuboidal shape with curved corners and sides (i.e., as will be described in the following disclosure, the inflatable portion 12 is deliberately structured so as to not form or otherwise provide a spherical shape).

Figure 8:
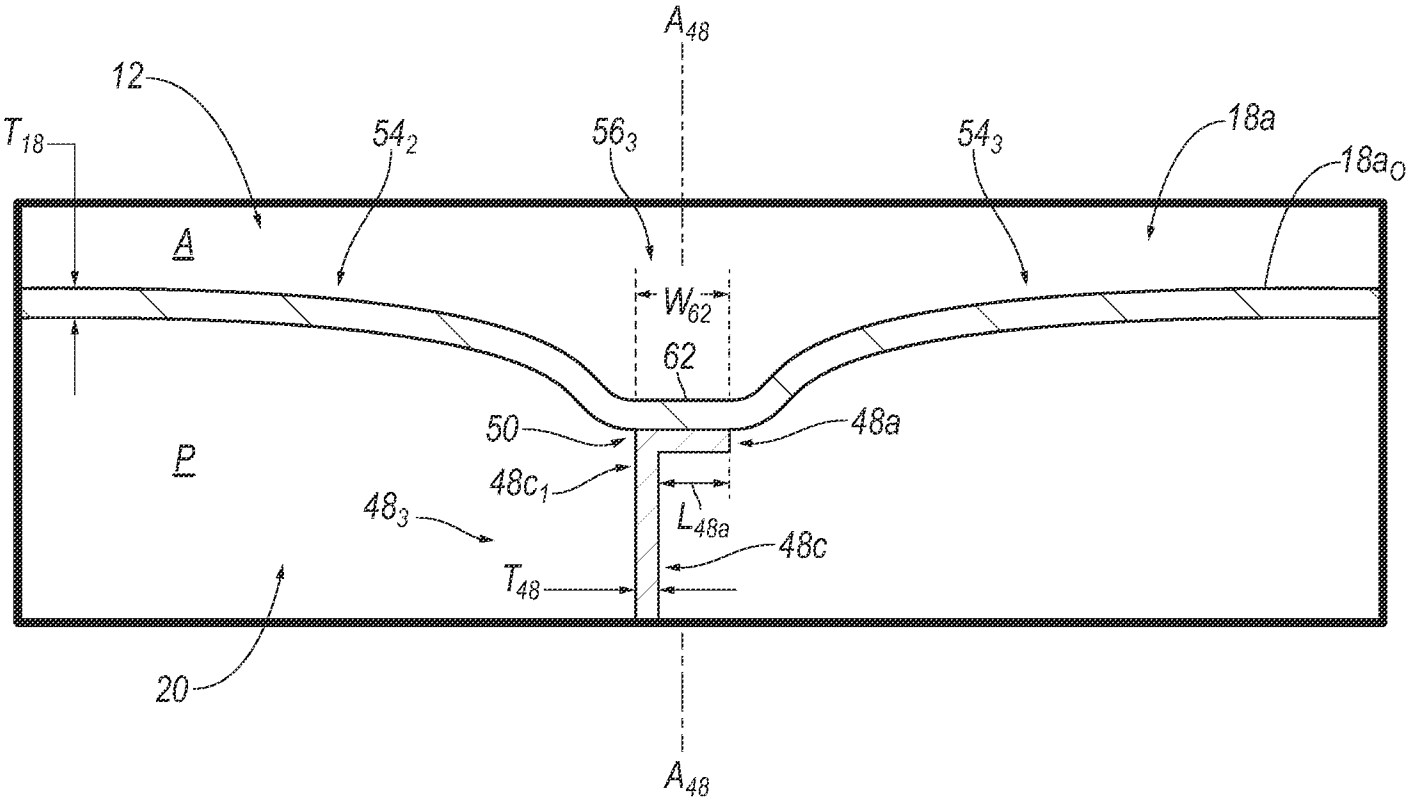
FIG. 8 is an enlarged view of the inflatable portion according to line 8 of FIG. 7.
Figure 9:
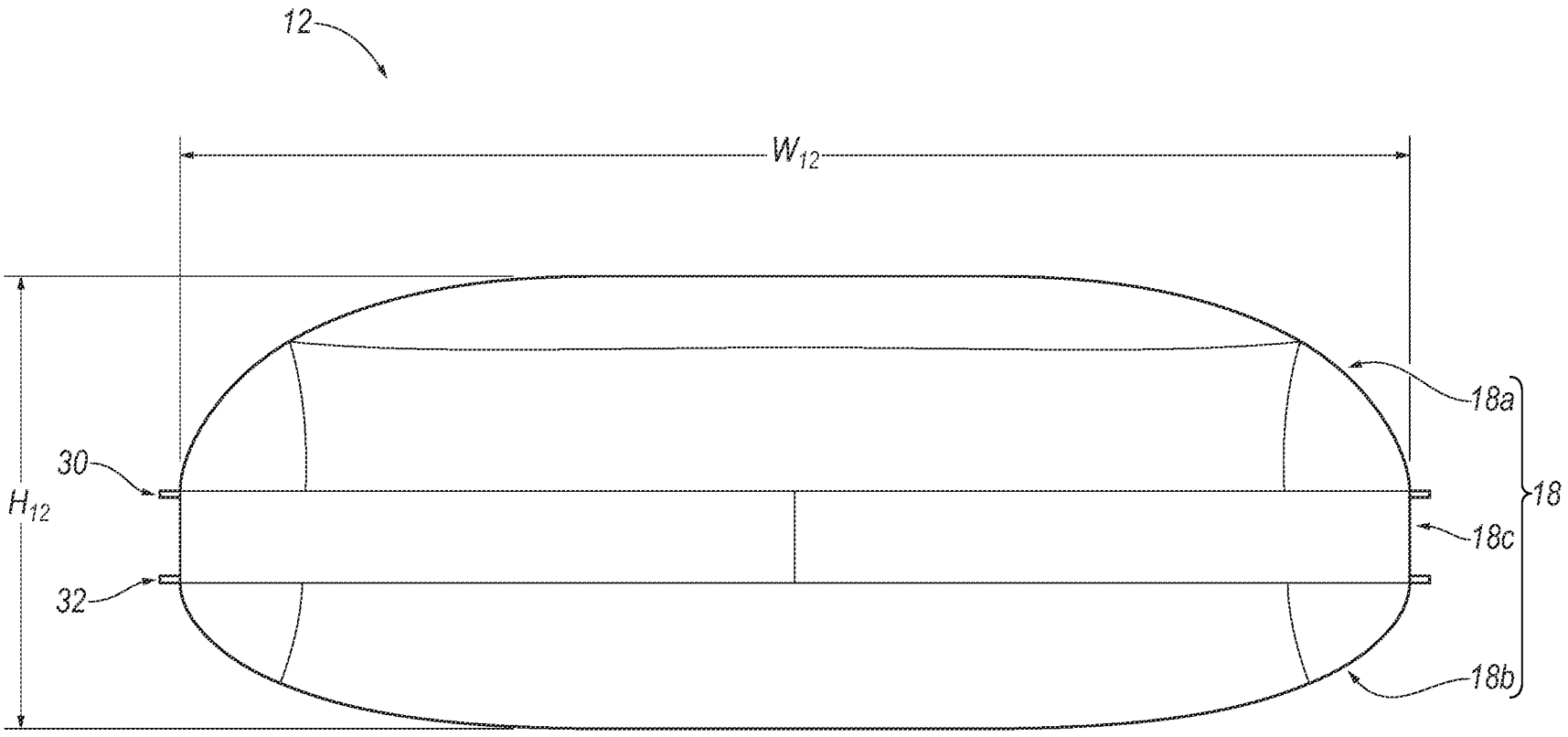
FIG. 9 is an end view of the inflatable portion according to arrow 9 of FIG. 4.

In some implementations, the body 18 is formed from one or more fluid barrier sheets having a thickness $T_{18}$ (see, e.g., FIG. 8) that prevents a pressurized fluid P (see, e.g., FIG. 8), such as, for example, air or water, to escape from the fluid-receiving cavity 20 to surrounding atmosphere A (see, e.g., FIG. 8). One or more materials may define the one or more fluid barrier sheets; in some examples, a polymer material, such as, for example, a polyurethane material may define the one or more fluid barrier sheets. The thickness $T_{18}$ of the one or more fluid barrier sheets may be any desirable thickness, ranging from, for example, about 0.05 centimeters (cm) to about 0.2 centimeters (cm), or 0.05 centimeters (cm).

In some configurations, the one or more fluid barrier sheets that form the body 18 of the inflatable portion 12 may include a first fluid barrier sheet, a second fluid barrier sheet, and a third fluid barrier sheet. With reference to FIGS. 3, 4, and 6, the first fluid barrier sheet is configured to form an upper dome portion 18*a* of the body 18 upon inflation of the inflatable portion 12 with the pressurized fluid P. As seen at FIGS. 3, 5, and 6; the second fluid barrier sheet is configured to form a lower bowl portion 18*b* of the body 18 upon inflation of the inflatable portion 12 with the pressurized fluid P. Referring to FIGS. 3 and 6, the third fluid barrier sheet is configured to form an intermediate band portion 18*c* of the body 18 upon inflation of the inflatable portion 12 with the pressurized fluid P.

Figure 7:
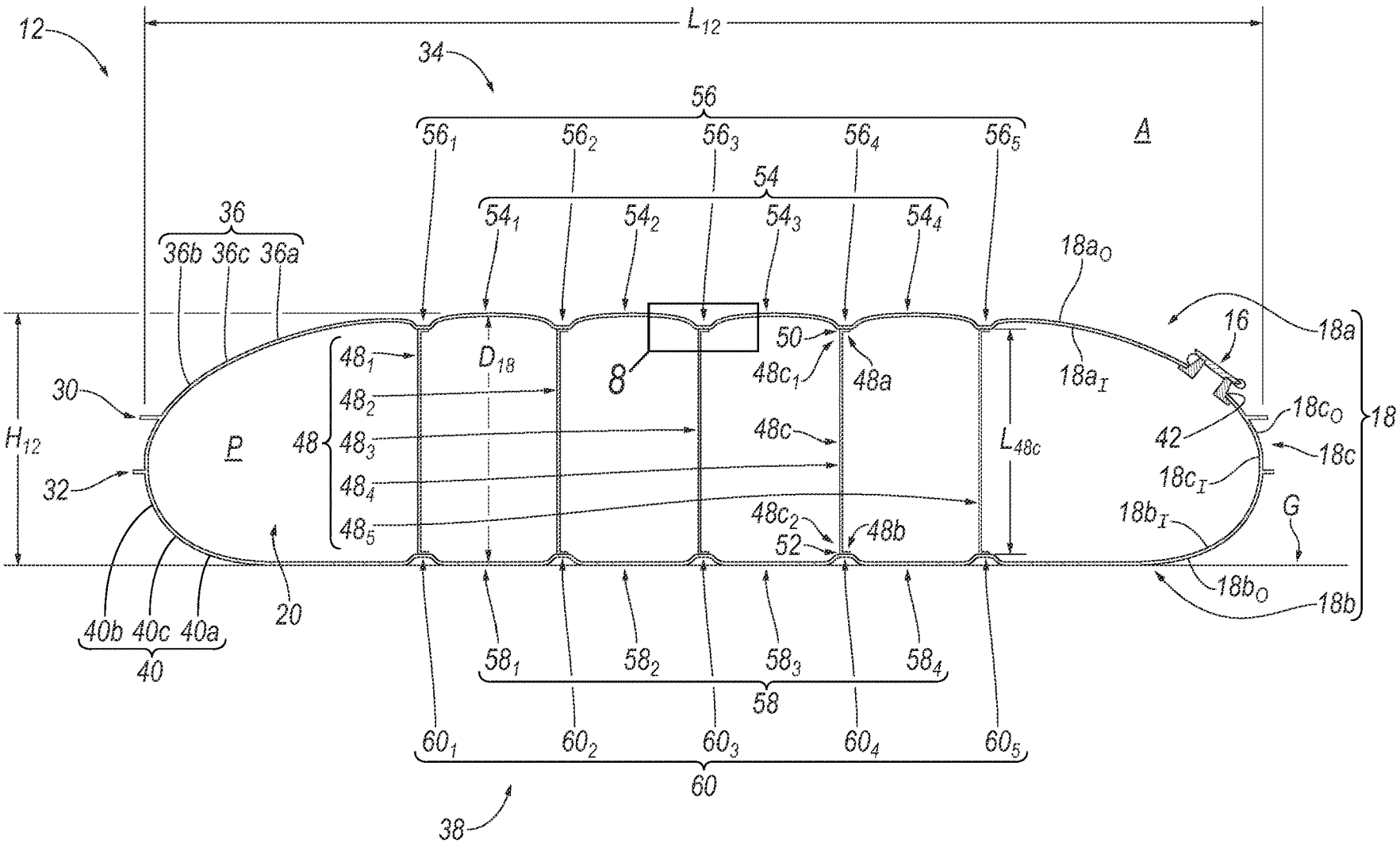
FIG. 7 is a cross-sectional view of the inflatable portion according to line 7-7 of FIG. 4.

With reference to FIGS. 3, 6, and 7, the body 18 may include a first sealed flange portion 30 and a second sealed flange portion 32. As seen at FIG. 6, the first sealed flange portion 30 may be formed by a sealed connection of: (1) a lower perimeter $18a_L$ of the first fluid barrier sheet forming the upper dome portion 18*a* to (2) an upper perimeter $18c_U$ of the third fluid barrier sheet forming the intermediate band portion 18*c*. The second sealed flange portion 32 may be formed by a sealed connection of: (1) an upper perimeter $18b_U$ of the second fluid barrier sheet forming the lower bowl portion 18*b* to (2) a lower perimeter $18c_L$ of the third fluid barrier sheet forming the intermediate band portion 18*c*.

As described above, the third fluid barrier sheet that forms the intermediate band portion 18*c* is utilized for connecting the first fluid barrier sheet forming the upper dome portion 18*a* to the second fluid barrier sheet that forms the lower bowl portion 18*b*. In some configurations, the intermediate band portion 18*c* is configured to form a substantially elliptical shape upon inflation of the inflatable portion 12 with the pressurized fluid P. Accordingly, as a result of the substantially elliptical shape provided by the intermediate band portion 18*c*, the lower perimeter $18a_L$ of the upper dome portion 18*a* that is connected to the upper perimeter $18c_U$ of the intermediate band portion 18*c* may correspondingly define an elliptical shape (as seen at FIG. 4), and the upper perimeter $18b_U$ of the lower bowl portion 18*b* that is connected to the lower perimeter $18a_L$ of the intermediate band portion 18*c* may also correspondingly define an elliptical shape (as seen at FIG. 5).

In some implementations, the upper dome portion 18*a* includes a substantially flat top wall portion 34 (see, e.g., FIGS. 3, 4, and 6) and a curved, concave-down sidewall portion 36 (see, e.g., FIGS. 3, 4, and 6). The substantially flat top wall portion 34 is generally bounded by a perimeter region having, for example, a substantially rectangular shape (see, e.g., FIG. 4) defined by a length $L_{34}$ (see, e.g., FIGS. 4 and 6) and a width $W_{34}$ (see, e.g., FIG. 4). As seen at FIG. 6, the curved, concave-down sidewall portion 36 includes: (1) an upper region 36*a* extending from the perimeter region of the substantially flat top wall portion 34; (2) a lower region 36*b* extending from the first sealed flange 30 of the body 18; and (3) an intermediate region 36*c* extending between the upper region 36*a* of the curved, concave-down sidewall portion 36 and the lower region 36*b* of the curved, concave-down sidewall portion 36.

In some examples, the lower bowl portion 18*b* includes a substantially flat bottom wall portion 38 (see, e.g., FIGS. 5 and 6) and a curved, concave-up sidewall portion 40 (see, e.g., FIGS. 5 and 6). The substantially flat bottom wall portion 38 is generally bounded by a perimeter region having, for example, a substantially rectangular shape (see, e.g., FIG. 5) defined by a length $L_{38}$ (see, e.g., FIGS. 5 and 6) and a width $W_{38}$ (see, e.g., FIG. 5). As seen at FIG. 6, the curved, concave-up sidewall portion 40 includes: (1) a lower region 40*a* extending from the perimeter region of the substantially flat bottom wall portion 38; (2) an upper region 40*b* extending from the second sealed flange 32 of the body 18; and (3) an intermediate region 40*c* extending between the lower region 40*a* of the curved, concave-up sidewall portion 40 and the upper region 40*b* of the curved, concave-up sidewall portion 40.

In some examples, the width $W_{34}$ of substantially flat top wall portion 34 may be approximately equal to 20.0 to 30.0 centimeters (cm), and the length $L_{34}$ of substantially flat top wall portion 34 may be approximately equal to 40.0 to 60.0 centimeters (cm) thereby providing a surface area of the substantially flat top wall portion 34 that may be approximately equal to 800 to 1,800 square-centimeters ($cm^2$). Furthermore, in some examples, the width $W_{38}$ of substantially flat bottom wall portion 38 may be approximately equal to 25.0 to 35.0 centimeters (cm), and the length $L_{38}$ of substantially flat bottom wall portion 38 may be approximately equal to 45.0 to 55.0 centimeters (cm) thereby providing a surface area of the substantially flat bottom wall portion 38 that may be approximately equal to 1,125 to 1,925 square-centimeters ($cm^2$). Accordingly, some implementations of the inflatable portion 12 may provide a surface area ratio of the substantially flat bottom wall portion 38 to the substantially flat top wall portion 34 that is approximately 1.00:1.14.

With reference to FIG. 7, at approximately a region of the intermediate region 36*c* of the curved, concave-down sidewall portion 36 may form a valve-receiving opening 42 that is sized for supporting the valve 16 on the body 18 of the inflatable portion 12. Once the valve 16 is arranged within the valve-receiving opening 42 and fluidly-secured to the body 18, the fluid-receiving cavity 20 of the body 18 of the inflatable portion 12 is sealed from surrounding atmosphere A.

Referring to FIGS. 3 and 4, in some instances, the first fluid barrier sheet forming the upper dome portion 18*a* may include a one or more material-concentrated seams 44*a*-44*e*. The one or more material-concentrated seams 44*a*-44*d* may demarcate the curved, concave-down sidewall portion 36 into a plurality of regions, such as, for example: (1) a first curved, concave-down sidewall end region $\mathbf{36}_1$ that defines the valve-receiving opening 42; (2) a second curved, concave-down sidewall region $\mathbf{36}_2$ arranged opposite the first curved, concave-down sidewall end region $\mathbf{36}_1$; (3) a front curved, concave-down sidewall region $\mathbf{36}_3$; and (4) a rear curved, concave-down sidewall region $\mathbf{36}_4$ arranged opposite the front curved, concave-down sidewall region $\mathbf{36}_3$. The material-concentrated seam 44*e*, however, does not demarcate the curved, concave-down sidewall portion 36 into a region, but, rather, may reinforce a portion of the intermediate region 36*c* of the curved, concave-down sidewall portion 36 that forms the valve-receiving opening 42

Referring to FIGS. 5 and 6, in some instances, the second fluid barrier sheet forming the lower bowl portion 18*b* may include a one or more material-concentrated seams 46*a*-46*d*. The one or more material-concentrated seams 46*a*-46*d* may demarcate the curved, concave-up sidewall portion 40 into a plurality of regions, such as, for example: (1) a first curved, concave-up sidewall end region $\mathbf{40}_1$; (2) a second curved, concave-up sidewall region $\mathbf{40}_2$ arranged opposite the first curved, concave-up sidewall end region $\mathbf{40}_1$; (3) a front curved, concave-up sidewall region $\mathbf{40}_3$; and (4) a rear curved, concave-up sidewall region $\mathbf{40}_4$ arranged opposite the front curved, concave-up sidewall region $\mathbf{40}_3$.

The one or more material-concentrated seams 44*a*-44*e*, 46*a*-46*d* may be formed by selectively heating, selectively ultra-sonically welding, or other suitable bonding of one or more regions of, respectively, the first fluid barrier sheet and the second fluid barrier sheet. The one or more material-concentrated seams 44*a*-44*e*, 46*a*-46*d* may assist in the distribution of an externally-applied force F or applied weight (see, e.g., FIG. 6) from surrounding atmosphere A to the inflatable portion 12 that may be substantially perpendicular to an underlying support surface or ground surface G. (see, e.g., FIG. 6). Although the externally-applied force F is shown being applied in a direction toward the substantially flat top wall portion 34 in FIG. 6 (while the substantially flat bottom wall portion 38 is arranged opposite the underlying support surface or ground surface G), in other instances, the inflatable portion 12 could be flipped over such that the externally-applied force F could be applied to the substantially flat bottom wall portion 38 (while the substantially flat top wall portion 34 is arranged opposite the underlying support surface or ground surface G).

In some examples, the externally-applied force F may arise from one or both of a user's feet arranged upon the substantially flat top wall portion 34 of the upper dome portion 18*a* of the body 18 of the inflatable portion 12. In some implementations, one or a combination of the selected materials and the structural configuration of the inflatable portion 12 may withstand an externally-applied force F or applied weight or load that may be less than or approximately equal to a user that may weigh approximately, for example, 700 pounds (lbs.), 500 pounds (lbs.), 300 pounds (lbs.), or the like. Although the inflatable portion 12 may be configured to withstand an externally-applied force F or applied weight or load of a plurality of differently-sized users, the inflatable portion 12 may be configured to withstand any type of user that may weight, for example, greater than 700 pounds (lbs.).

Referring to FIG. 7, the upper dome portion 18*a*, the lower bowl portion 18*b*, and the intermediate band portion 18*c* of the body 18 respectively includes an inner surface $\mathbf{18}a_I$, $\mathbf{18}b_I$, $\mathbf{18}c_I$. The inner surfaces $\mathbf{18}a_I$, $\mathbf{18}b_I$, $\mathbf{18}c_I$ of the upper dome portion 18*a*, the lower bowl portion 18*b*, and the intermediate band portion 18*c* of the body 18 define the fluid-receiving cavity 20 for containing the pressurized fluid P. The upper dome portion 18*a*, the lower bowl portion 18*b*, and the intermediate band portion 18*c* of the body 18 also respectively include an outer surface $\mathbf{18}a_O$, $\mathbf{18}b_O$, $\mathbf{18}c_O$ that face surrounding atmosphere A.

As also see at FIG. 7, in some implementations, the inflatable portion 12 may include a plurality of ribs 48 that define a skeletal load support matrix disposed within the fluid-receiving cavity 20. With reference to FIG. 7, the plurality of ribs 48 may include a first rib $\mathbf{48}_1$, a second rib $\mathbf{48}_2$, a third rib $\mathbf{48}_3$, a fourth rib $\mathbf{48}_4$, and a fifth rib $\mathbf{48}_5$ (whereby, for example, the second rib $\mathbf{48}_2$, the third rib $\mathbf{48}_3$, and the fourth rib $\mathbf{48}_4$ may be referred to as intermediate rib whereas the first rib $\mathbf{48}_1$ and the fifth rib $\mathbf{48}_5$ may be referred to as end ribs). In some implementations, each rib $\mathbf{48}_1$, $\mathbf{48}_2$, $\mathbf{48}_3$, $\mathbf{48}_4$, $\mathbf{48}_5$ of the plurality of ribs 48 may be formed from a polymer material, such as, for example, a polyurethane material in a substantially similar manner as that of the one or more fluid barrier sheets that form the upper dome portion 18*a*, the lower bowl portion 18*b*, and the intermediate band portion 18*c* of the body 18 of the inflatable portion 12.

Referring to FIG. 7, when each rib $\mathbf{48}_1$, $\mathbf{48}_2$, $\mathbf{48}_3$, $\mathbf{48}_4$, $\mathbf{48}_5$ of the plurality of ribs 48 is viewed in a cross-sectional length-wise direction along the length $L_{12}$ of the inflatable portion 12, each rib $\mathbf{48}_1$, $\mathbf{48}_2$, $\mathbf{48}_3$, $\mathbf{48}_4$, $\mathbf{48}_5$ of the plurality of ribs 48 may include: (1) a first segment 48*a* (see also FIG. 8) attached to the inner surface $\mathbf{18}a_I$ of the upper dome portion 18*a*; (2) a second segment 48*b* attached to the inner surface $\mathbf{18}b_I$ of the lower bowl portion 18*b*; and (3) a third segment 48*c* (see also FIG. 8) extending between and connecting the first segment 48*a* to the second segment 48*b*. In some examples, the third segment 48*c* includes: (1) a first end $\mathbf{48}c_I$ connected to the first segment 48*a* for defining a first living hinge 50 (see also FIG. 8) of each rib $\mathbf{48}_1$, $\mathbf{48}_2$, $\mathbf{48}_3$, $\mathbf{48}_4$, $\mathbf{48}_5$ of the plurality of ribs 48; and (2) a second end $\mathbf{48}c_2$ connected to the second segment 48*b* for defining a second living hinge 52 of each rib $\mathbf{48}_1$, $\mathbf{48}_2$, $\mathbf{48}_3$, $\mathbf{48}_4$, $\mathbf{48}_5$ of the plurality of ribs 48.

Figure 10:
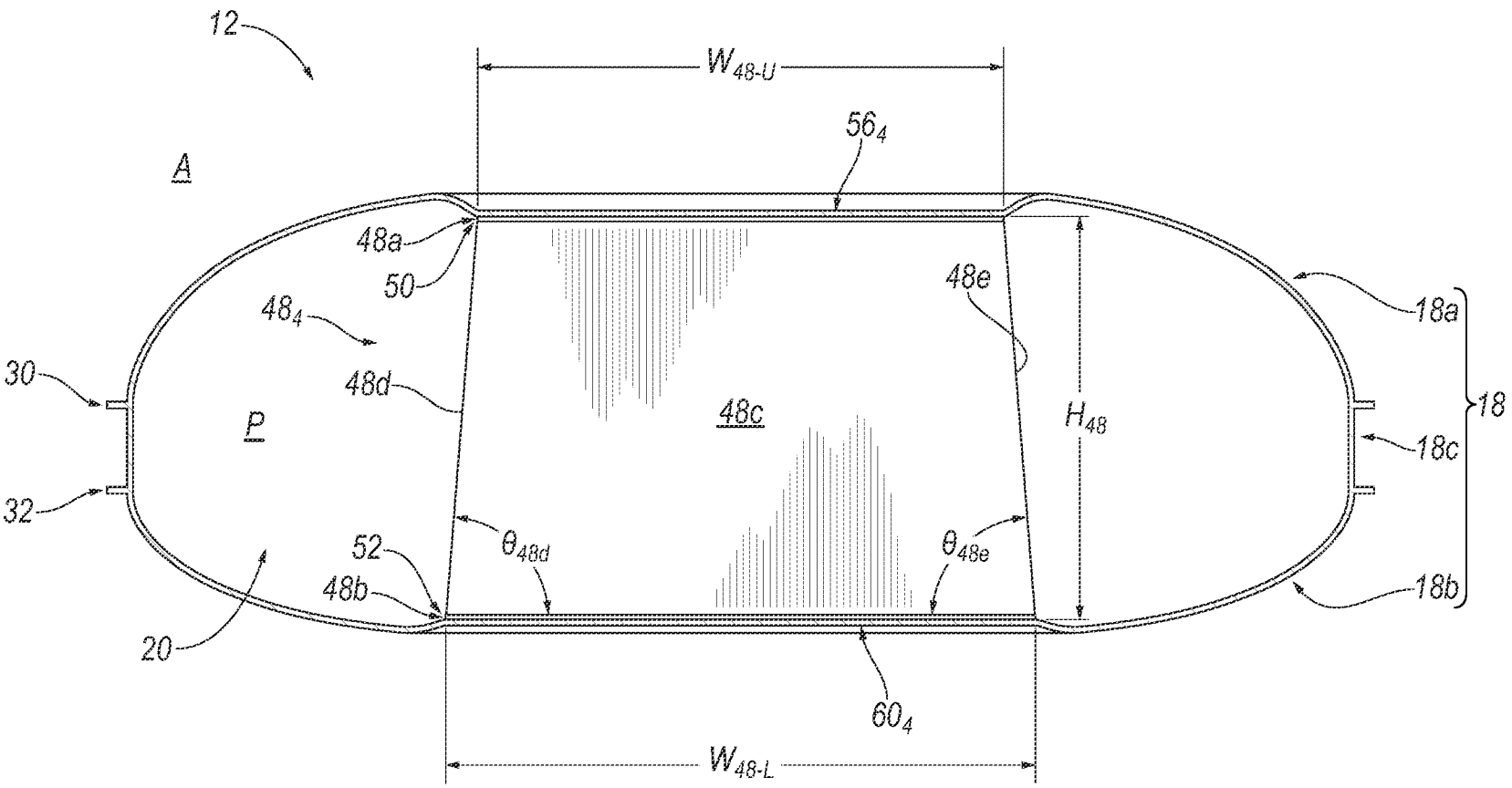
FIG. 10 is a cross-sectional view of the inflatable portion according to line 10-10 of FIG. 4.

With reference to FIG. 10, each rib $\mathbf{48}_1$, $\mathbf{48}_2$, $\mathbf{48}_3$, $\mathbf{48}_4$, $\mathbf{48}_5$ of the plurality of ribs 48 may include a height $H_{48}$, an upper width $W_{48\text{-}U}$ (see also, e.g., FIG. 4) that extends along a portion of the width $W_{12}$ of the inflatable portion 12, and a lower width $W_{48\text{-}L}$ (see also, e.g., FIG. 5) that extends along a portion of the width $W_{12}$ of the inflatable portion 12. Furthermore, as seen at FIG. 10, each rib $\mathbf{48}_1$, $\mathbf{48}_2$, $\mathbf{48}_3$, $\mathbf{48}_4$, $\mathbf{48}_5$ of the plurality of ribs 48 includes a first sidewall 48*d* of the third segment and a second sidewall 48*e* of the third segment 48*c* each having an upper end extending between the upper width $W_{48\text{-}U}$ and each having a lower end extending between the lower width $W_{48\text{-}L}$.

The first living hinge 50 extends along the upper width $W_{48\text{-}U}$ of each rib $\mathbf{48}_1$, $\mathbf{48}_2$, $\mathbf{48}_3$, $\mathbf{48}_4$, $\mathbf{48}_5$ of the plurality of ribs 48. The second living hinge 52 extends along the lower width $W_{48\text{-}L}$ of each rib $\mathbf{48}_1$, $\mathbf{48}_2$, $\mathbf{48}_3$, $\mathbf{48}_4$, $\mathbf{48}_5$ of the plurality of ribs 48.

As seen at FIG. 10, the lower width $W_{48\text{-}L}$ may be greater than the upper width $W_{48\text{-}U}$; therefore, each rib $\mathbf{48}_1$, $\mathbf{48}_2$, $\mathbf{48}_3$, $\mathbf{48}_4$, $\mathbf{48}_5$ of the plurality of ribs 48 may define a substantially trapezoidal shape when the inflatable portion 12 is viewed in a width-wise direction along the width $W_{12}$ of the inflatable portion 12. Accordingly, the first sidewall 48*d* of the third segment 48*c* may extend away from the second segment 48*b* at an acute angle $\theta_{48d}$, and the second sidewall 48*e* of the third segment 48*c* may extend away from the second segment 48*b* at an acute angle $\theta_{48e}$.

In some implementations, the upper width $W_{48\text{-}U}$ of each rib $\mathbf{48}_1$, $\mathbf{48}_2$, $\mathbf{48}_3$, $\mathbf{48}_4$, $\mathbf{48}_5$ of the plurality of ribs 48 may be approximately equal to 15.0 to 25.0 centimeters (cm). In other implementations, the lower width $W_{48\text{-}L}$ of each rib $\mathbf{48}_1$, $\mathbf{48}_2$, $\mathbf{48}_3$, $\mathbf{48}_4$, $\mathbf{48}_5$ of the plurality of ribs 48 may be approximately equal to 20.0 to 30.0 centimeters (cm).

Because each rib $\mathbf{48}_1$, $\mathbf{48}_2$, $\mathbf{48}_3$, $\mathbf{48}_4$, $\mathbf{48}_5$ of the plurality of ribs 48, the upper dome portion 18*a*, the lower bowl portion 18*b*, and the intermediate band portion 18*c* of the body 18 may be formed from a polymer material, such as, for example, a polyurethane material, the inflatable portion 12 may be arranged in a substantially folded-flat, rolled or other compact state when the inflated portion 12 is arranged in a deflated state. Furthermore, as a result of incorporation of the first living hinge 50 and the second living hinge 52, when the inflatable portion 12 is transitioned from an expanded-and-inflated state to a compact-and-deflated state by evacuating the pressurized fluid P out of the valve 16, each rib $\mathbf{48}_1$, $\mathbf{48}_2$, $\mathbf{48}_3$, $\mathbf{48}_4$, $\mathbf{48}_5$ of the plurality of ribs 48 is permitted to "diagonally fall" or "diagonally collapse" upon on one another (in a similar fashion as that of a series of dominos that tip over an adjacent domino in successive order) while remaining attached to inner surfaces $\mathbf{18}a_I$, $\mathbf{18}b_I$ of the upper dome portion 18*a* and the lower bowl portion 18*b* as will be described in the following disclosure.

With reference to FIG. 4, in some configurations, the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 may be spaced apart from an opposing third segment 48*c* of each rib $\mathbf{48}_1$, $\mathbf{48}_2$, $\mathbf{48}_3$, $\mathbf{48}_4$, $\mathbf{48}_5$ of the plurality of ribs 48 at distance or spacing $S_{48}$ along the length $L_{12}$ of the inflatable portion 12. The length-wise distance or spacing $S_{48}$ of opposing third segments 48*c* of each rib $\mathbf{48}_1$, $\mathbf{48}_2$, $\mathbf{48}_3$, $\mathbf{48}_4$, $\mathbf{48}_5$ of the plurality of ribs 48 may be approximately equal to 8.0 centimeters (cm).

Referring to FIG. 8, each rib $\mathbf{48}_1$, $\mathbf{48}_2$, $\mathbf{48}_3$, $\mathbf{48}_4$, $\mathbf{48}_5$ of the plurality of ribs 48 is defined by a rib thickness $T_{48}$. In some implementations, the rib thickness $T_{48}$ may be approximately equal to 0.5 to 2.00 centimeters (cm).

Each of the first segment 48*a* and the second segment 48*b* of each rib $\mathbf{48}_1$, $\mathbf{48}_2$, $\mathbf{48}_3$, $\mathbf{48}_4$, $\mathbf{48}_5$ of the plurality of ribs 48 is defined by a length (see, e.g., length $L_{48a}$ of the first segment 48*a* of the rib $\mathbf{48}_3$ at FIG. 8). In some implementations, the length $L_{48a}$ of each of the first segment 48*a* and the second segment 48*b* of each rib $\mathbf{48}_1$, $\mathbf{48}_2$, $\mathbf{48}_3$, $\mathbf{48}_4$, $\mathbf{48}_5$ of the plurality of ribs 48 may be any desirable length ranging from, for example, about 0.5 centimeters (cm) to about 1.5 centimeters (cm). In some instances, the length $L_{48a}$ may be approximately equal to 1.0 centimeters (cm).

With reference to FIG. 7, the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 is defined by a length $L_{48c}$. The length $L_{48c}$ of the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 is slightly less than the $H_{12}$ of the inflatable portion 12. Furthermore, the length $L_{48c}$ of the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 is slightly less than the height $H_{48}$ of each rib $\mathbf{48}_1$, $\mathbf{48}_2$, $\mathbf{48}_3$, $\mathbf{48}_4$, $\mathbf{48}_5$ of the plurality of ribs 48 when the inflatable portion 12 is arranged in the inflated state; when the inflatable portion 12 is arranged in the inflated state, the height $H_{48}$ of each rib $\mathbf{48}_1$, $\mathbf{48}_2$, $\mathbf{48}_3$, $\mathbf{48}_4$, $\mathbf{48}_5$ of the plurality of ribs 48 is defined by: (1) the length $L_{48c}$ of the third segment 48*c* of each rib $\mathbf{48}_1$, $\mathbf{48}_2$, $\mathbf{48}_3$, $\mathbf{48}_4$, $\mathbf{48}_5$ of the plurality of ribs 48; (2) the rib thickness $T_{48}$ of the first segment 48*a* of each rib $\mathbf{48}_1$, $\mathbf{48}_2$, $\mathbf{48}_3$, $\mathbf{48}_4$, $\mathbf{48}_5$ of the plurality of ribs 48; and (3) the rib thickness $T_{48}$ of the second segment 48*b* of each rib $\mathbf{48}_1$, $\mathbf{48}_2$, $\mathbf{48}_3$, $\mathbf{48}_4$, $\mathbf{48}_5$ of the plurality of ribs 48. In some implementations, the length $L_{48c}$ of the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 may be any desirable length ranging from, for example, about 10.0 centimeters (cm) to about 15.0 centimeters (cm). In some instances, the length $L_{48}$c may be approximately equal to 12.5 centimeters (cm).

The first segment 48*a* of each rib $\mathbf{48}_1$, $\mathbf{48}_2$, $\mathbf{48}_3$, $\mathbf{48}_4$, $\mathbf{48}_5$ of the plurality of ribs 48 may be joined to the inner surface $\mathbf{18}a_I$ of the upper dome portion 18*a* by use of an adhesive or material deformation such as, for example, heating or ultra-sonic welding. The second segment 48*b* of each rib $\mathbf{48}_1$, $\mathbf{48}_2$, $\mathbf{48}_3$, $\mathbf{48}_4$, $\mathbf{48}_5$ of the plurality of ribs 48 may be joined to the inner surface $\mathbf{18}b_I$ of the lower bowl portion 18*b* by use of an adhesive or material deformation such as, for example, heating or ultra-sonic welding.

In an exemplary method of manufacturing the inflatable portion 12, in a first step, the valve 16 is secured to the valve-receiving opening 42 formed by the body 18 of the inflatable portion 12. Then, in a second step, the first segment 48*a* of each rib $\mathbf{48}_1$, $\mathbf{48}_2$, $\mathbf{48}_3$, $\mathbf{48}_4$, $\mathbf{48}_5$ of the plurality of ribs 48 may be joined to the inner surface $\mathbf{18}a_I$ of the upper dome portion 18*a*. Then, in a third step, the second segment 48*b* of each rib $\mathbf{48}_1$, $\mathbf{48}_2$, $\mathbf{48}_3$, $\mathbf{48}_4$, $\mathbf{48}_5$ of the plurality of ribs 48 may be joined to the inner surface $\mathbf{18}b_I$ of the lower bowl portion 18*b*. Then, in a fourth step, the first sealed flange portion 30 may be formed by a sealed connection of: (1) a lower perimeter $\mathbf{18}a_L$ of the first fluid barrier sheet forming the upper dome portion 18*a* to (2) an upper perimeter $\mathbf{18}c_U$ of the third fluid barrier sheet forming the intermediate band portion 18*c*. Then, in a fifth step, the second sealed flange portion 32 may be formed by a sealed connection of: (1) an upper perimeter $\mathbf{18}b_U$ of the second fluid barrier sheet forming the lower bowl portion 18*b* to (2) a lower perimeter $\mathbf{18}c_L$ of the third fluid barrier sheet forming the intermediate band portion 18*c*.

When the inflatable portion 12 is arranged in an inflated state with a pressurized fluid P as seen at FIG. 7, the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 extends substantially perpendicularly with respect to: (1) a region of the inner surface $\mathbf{18}a_I$ of the upper dome portion 18*a* that is bound by the substantially flat top wall portion 34 of the upper dome portion 18*a*; and (2) a region of the inner surface $\mathbf{18}b_I$ of the lower bowl portion 18*b* that is bound by the substantially flat bottom wall portion 38 of the lower bowl portion 18*b*. Furthermore, when the inflatable portion 12 is arranged in an inflated state with a pressurized fluid P as seen at FIG. 7, each of the first segment 48*a* and the second segment 48*b* of each rib $\mathbf{48}_1$, $\mathbf{48}_2$, $\mathbf{48}_3$, $\mathbf{48}_4$, $\mathbf{48}_5$ of the plurality of ribs 48 extends substantially perpendicularly with respect to the third segment 48*c* at, respectively, the first living hinge 50 and the second living hinge 52 thereby defining each rib $\mathbf{48}_1$, $\mathbf{48}_2$, $\mathbf{48}_3$, $\mathbf{48}_4$, $\mathbf{48}_5$ of the plurality of ribs 48 to have a substantially C-shape (see, e.g., FIGS. 3 and 7).

With continued reference to FIG. 7, when the inflatable portion 12 is arranged in an inflated state with a pressurized fluid P, the length $L_{48c}$ of the third segment 48*c* of each rib $\mathbf{48}_1$, $\mathbf{48}_2$, $\mathbf{48}_3$, $\mathbf{48}_4$, $\mathbf{48}_5$ of the plurality of ribs 48 functions as a tether and limits a distance $D_{18}$ that the inner surface $\mathbf{18}a_I$, $\mathbf{18}b_I$ of each of the upper dome portion 18*a* and the lower bowl portion 18*b* are permitted to travel away from one another within the confines of the substantially flat top wall portion 34 of the upper dome portion 18*a* and the substantially flat bottom wall portion 38 of the lower bowl portion 18*b*. Therefore, upon being inflated with the pressurized fluid P, the inflatable portion 12 limits the height $H_{12}$ of the inflatable portion 12 that extends between: (1) the outer surface $\mathbf{18}a_O$ of the body 18 that is bound by the substantially flat top wall portion 34 of the upper dome portion 18*a*; and (2) the outer surface $\mathbf{18}b_O$ of the body 18 that is bound by the substantially flat bottom wall portion 38 of the lower bowl portion 18*b*.

Because each rib $\mathbf{48}_1$, $\mathbf{48}_2$, $\mathbf{48}_3$, $\mathbf{48}_4$, $\mathbf{48}_5$ of the plurality of ribs 48 functions as a tether as described above, the inflatable portion 12, when inflated, does not form a spherical shape. More specifically, when the inflatable portion 12 is inflated, the inflatable portion 12 may be confined to a generally rectangular cuboidal space according to, for example, the length $L_{12}$, width $W_{12}$, and the height $H_{12}$ of the inflatable portion 12. Therefore, as a result of one or a combination of structural features (e.g., the inclusion of the plurality of ribs 48 that function as tethers), the inflatable portion 12 is prevented from ever forming a spherical shape.

As described above, the one or more material-concentrated seams 44*a*-44*e*, 46*a*-46*d* may assist in the distribution of the externally-applied force F (see, e.g., FIG. 6) to the inflatable portion 12. Furthermore, in addition to each rib $\mathbf{48}_1$, $\mathbf{48}_2$, $\mathbf{48}_3$, $\mathbf{48}_4$, $\mathbf{48}_5$ of the plurality of ribs 48 functioning as a tether as described above, each rib $\mathbf{48}_1$, $\mathbf{48}_2$, $\mathbf{48}_3$, $\mathbf{48}_4$, $\mathbf{48}_5$ of the plurality of ribs 48 may also assist in the distribution of the externally-applied force F or applied weight or load to the inflatable portion 12.

In addition to each rib $\mathbf{48}_1$, $\mathbf{48}_2$, $\mathbf{48}_3$, $\mathbf{48}_4$, $\mathbf{48}_5$ of the plurality of ribs 48 functioning as a tether as described above, like the one or more material-concentrated seams 44*a*-44*e*, 46*a*-46*d*, each rib $\mathbf{48}_1$, $\mathbf{48}_2$, $\mathbf{48}_3$, $\mathbf{48}_4$, $\mathbf{48}_5$ of the plurality of ribs 48 may assist in the distribution of the externally-applied force F (see, e.g., FIG. 6) to the inflatable portion 12 that may be substantially perpendicular to an underlying support surface or ground surface G. (see, e.g., FIG. 6).

Furthermore, as seen at FIGS. 7-8, upon being inflated with the pressurized fluid P, the outer surface $\mathbf{18}a_O$ of the upper dome portion 18*a* that defines the substantially flat top wall portion 34 of the upper dome portion 18*a* includes a textured pattern such as, for example, a tread pattern. The tread pattern is defined by plurality of peaks or bulging portions 54 that extend, in parallel along the width $W_{12}$ of the inflatable portion 12, and a plurality of grooves 56 that extend, in parallel along the width $W_{12}$ of the inflatable portion 12.

The plurality of bulging portions 54 include a first bulging portion $\mathbf{54}_1$, a second bulging portion $\mathbf{54}_2$, a third bulging portion $\mathbf{54}_3$, and a fourth bulging portion $\mathbf{54}_4$. The plurality of grooves 56 include a first groove $\mathbf{56}_1$, a second groove $\mathbf{56}_2$, a third groove $\mathbf{56}_3$, a fourth groove $\mathbf{56}_4$, and a fifth groove $\mathbf{56}_5$. The first bulging portion $\mathbf{54}_1$ is arranged between the first groove $\mathbf{56}_1$ and the second groove $\mathbf{56}_2$. The second bulging portion $\mathbf{54}_2$ is arranged between the second groove $\mathbf{56}_2$ and the third groove $\mathbf{56}_3$. The third bulging portion $\mathbf{54}_3$ is arranged between the third groove $\mathbf{56}_3$ and the fourth groove $\mathbf{56}_4$. The fourth bulging portion $\mathbf{54}_4$ is arranged between the fourth groove $\mathbf{56}_4$ and the fifth groove $\mathbf{56}_5$.

Similarly, as seen at FIG. 7, upon being inflated with the pressurized fluid P, the outer surface $\mathbf{18}b_O$ of the lower bowl portion 18*b* that defines the substantially flat bottom wall portion 38 of the lower bowl portion 18*b* includes a textured pattern such as, for example, a tread pattern. The tread pattern is defined by plurality of peaks or bulging portions 58 that extend, in parallel along the width $W_{12}$ of the inflatable portion 12, and a plurality of grooves 60 that extend, in parallel along the width $W_{12}$ of the inflatable portion 12.

The plurality of bulging portions 58 include a first bulging portion $\mathbf{58}_1$, a second bulging portion $\mathbf{58}_2$, a third bulging portion $\mathbf{58}_3$, and a fourth bulging portion $\mathbf{58}_4$. The plurality of grooves 60 include a first groove $\mathbf{60}_1$, a second groove $\mathbf{60}_2$, a third groove $\mathbf{60}_3$, a fourth groove $\mathbf{60}_4$, and a fifth groove $\mathbf{60}_5$. The first bulging portion $\mathbf{58}_1$ is arranged between the first groove $\mathbf{60}_1$ and the second groove $\mathbf{60}_2$. The second bulging portion $\mathbf{58}_2$ is arranged between the second groove $\mathbf{60}_2$ and the third groove $\mathbf{60}_3$. The third bulging portion $\mathbf{58}_3$ is arranged between the third groove $\mathbf{60}_3$ and the fourth groove $\mathbf{60}_4$. The fourth bulging portion $\mathbf{58}_4$ is arranged between the fourth groove $\mathbf{60}_4$ and the fifth groove $\mathbf{60}_5$.

As described above, each rib $\mathbf{48}_1$, $\mathbf{48}_2$, $\mathbf{48}_3$, $\mathbf{48}_4$, $\mathbf{48}_5$ of the plurality of ribs 48 functions as a tether and limits the distance $D_{18}$ that the inner surface $\mathbf{18}a_I$, $\mathbf{18}b_I$ of each of the upper dome portion 18*a* and the lower bowl portion 18*b* are permitted to travel away from one another. As seen at FIG. 7, the illustrated exemplary distance $D_{18}$ may define a maximum distance that extends between: (1) a region proximate a peak of each bulging portion $\mathbf{54}_1$, $\mathbf{54}_2$, $\mathbf{54}_3$, $\mathbf{54}_4$ of the plurality of bulging portions 54 of the of the upper dome portion 18*a* that defines the substantially flat top wall portion 34 of the upper dome portion 18*a*; and (2) a region proximate a peak of each bulging portion $\mathbf{58}_1$, $\mathbf{58}_2$, $\mathbf{58}_3$, $\mathbf{58}_4$ of the plurality of bulging portions 58 of the of the lower bowl portion 18*b* that defines the substantially flat bottom wall portion 38 of the lower bowl portion 18*b*.

With reference to FIG. 8, each groove $\mathbf{56}_1$, $\mathbf{56}_2$, $\mathbf{56}_3$, $\mathbf{56}_4$, $\mathbf{56}_5$ of the plurality of grooves 56 formed by the outer surface $\mathbf{18}a_O$ of the upper dome portion 18*a* includes a trough surface 62 that may define a trough width $W_{62}$. The trough width $W_{62}$ may be approximately equal to or slightly greater than the length $L_{48a}$ of the first segment 48*a* of each rib $\mathbf{48}_1$, $\mathbf{48}_2$, $\mathbf{48}_3$, $\mathbf{48}_4$, $\mathbf{48}_5$ of the plurality of ribs 48. Although not shown, each groove $\mathbf{60}_1$, $\mathbf{60}_2$, $\mathbf{60}_3$, $\mathbf{60}_4$, $\mathbf{60}_5$ of the plurality of grooves 60 formed by the outer surface $\mathbf{18}b_O$ of the lower bowl portion 18*b* may include a trough surface having a width that may be approximately equal to or slightly greater than the length of the second segment 48*b* of each rib $\mathbf{48}_1$, $\mathbf{48}_2$, $\mathbf{48}_3$, $\mathbf{48}_4$, $\mathbf{48}_5$ of the plurality of ribs 48. Accordingly, each groove $\mathbf{56}_1$, $\mathbf{56}_2$, $\mathbf{56}_3$, $\mathbf{56}_4$, $\mathbf{56}_5$ of the plurality of grooves 56 formed by the outer surface $\mathbf{18}a_O$ of the upper dome portion 18*a*, and, each groove $\mathbf{60}_1$, $\mathbf{60}_2$, $\mathbf{60}_3$, $\mathbf{60}_4$, $\mathbf{60}_5$ of the plurality of grooves 60 formed by the outer surface $\mathbf{18}a_O$ of the lower bowl portion 18*b* may be axially aligned with (see, e.g., rib axis $A_{48}$-$A_{48}$ in FIG. 8) and arranged opposite, respectively, the first segment 48*a* and the second segment 48*b* of each rib $\mathbf{48}_1$, $\mathbf{48}_2$, $\mathbf{48}_3$, $\mathbf{48}_4$, $\mathbf{48}_5$ of the plurality of ribs 48.

In view of the above-described exemplary configuration of the inflatable portion 12, the shape, size, and placement of each rib $\mathbf{48}_1$, $\mathbf{48}_2$, $\mathbf{48}_3$, $\mathbf{48}_4$, $\mathbf{48}_5$ of the plurality of ribs 48 contributes to a desired structural configuration that promotes use of the inflatable portion 12, alone, or, in combination with the outer casing portion 14, such that the assembly 10 functions as an abdominal core strength training exercise device or "stability board". For example, by selectively forming the lower width $W_{48\text{-}L}$ of each rib $\mathbf{48}_1$, $\mathbf{48}_2$, $\mathbf{48}_3$, $\mathbf{48}_4$, $\mathbf{48}_5$ of the plurality of ribs 48 to be greater than the upper width $W_{48\text{-}U}$ of each rib $\mathbf{48}_1$, $\mathbf{48}_2$, $\mathbf{48}_3$, $\mathbf{48}_4$, $\mathbf{48}_5$ of the plurality of ribs 48, the substantially rectangular shape (see, e.g., the length $L_{38}$ by the width $W_{38}$ in FIG. 5) of the substantially flat bottom wall portion 38 is greater than the substantially rectangular shape (see, e.g., the length $L_{34}$ by the width $W_{34}$ in FIG. 4) of the substantially flat top wall portion 34; accordingly, if a user wants to conduct a more challenging exercise by reducing the stability of the assembly 10 (or, the inflatable portion 12, alone), the user merely flips over the assembly 10 (or, the inflatable portion 12, alone) such that the smaller surface area defined by the substantially flat top wall portion 34 faces or is disposed adjacent the underlying support surface or ground surface G. Furthermore, because each rib $\mathbf{48}_1$, $\mathbf{48}_2$, $\mathbf{48}_3$, $\mathbf{48}_4$, $\mathbf{48}_5$ of the plurality of ribs 48 provides a dual function as tethers and force-distributing components, each rib $\mathbf{48}_1$, $\mathbf{48}_2$, $\mathbf{48}_3$, $\mathbf{48}_4$, $\mathbf{48}_5$ of the plurality of ribs 48 promotes the formation of the tread pattern imparted to the substantially flat top wall portion 34 and the substantially flat bottom wall portion 38 in order to increase friction against the underlying support surface or ground surface G or a sole surface of a user's shoes or feet while also distributing the externally-applied force F that may be substantially perpendicular to an underlying support surface or ground surface G as a result of a user standing on the assembly 10 (or, the inflatable portion 12, alone). Yet even further, the selected materials and structural configuration of the inflatable portion 12 results in the ability of the inflatable portion 12 to support relatively large loads that may support a user's entire body weight whereby the user may weigh, for example, approximately 700 pounds (lbs.).

Referring now to FIGS. 11-14, exemplary aspects of the outer casing portion 14 are shown. When the inflatable portion 12 is arranged in an expanded state and is disposed within the cavity 24 formed by the body 22 of the outer casing portion 14, the body 22 generally defines the outer casing portion 14 to include a length $L_{14}$ (see, e.g., FIGS. 12-14), a width $W_{14}$ (see, e.g., 12-13), and a height $H_{14}$ (see, e.g., FIG. 14).

Figure 11:
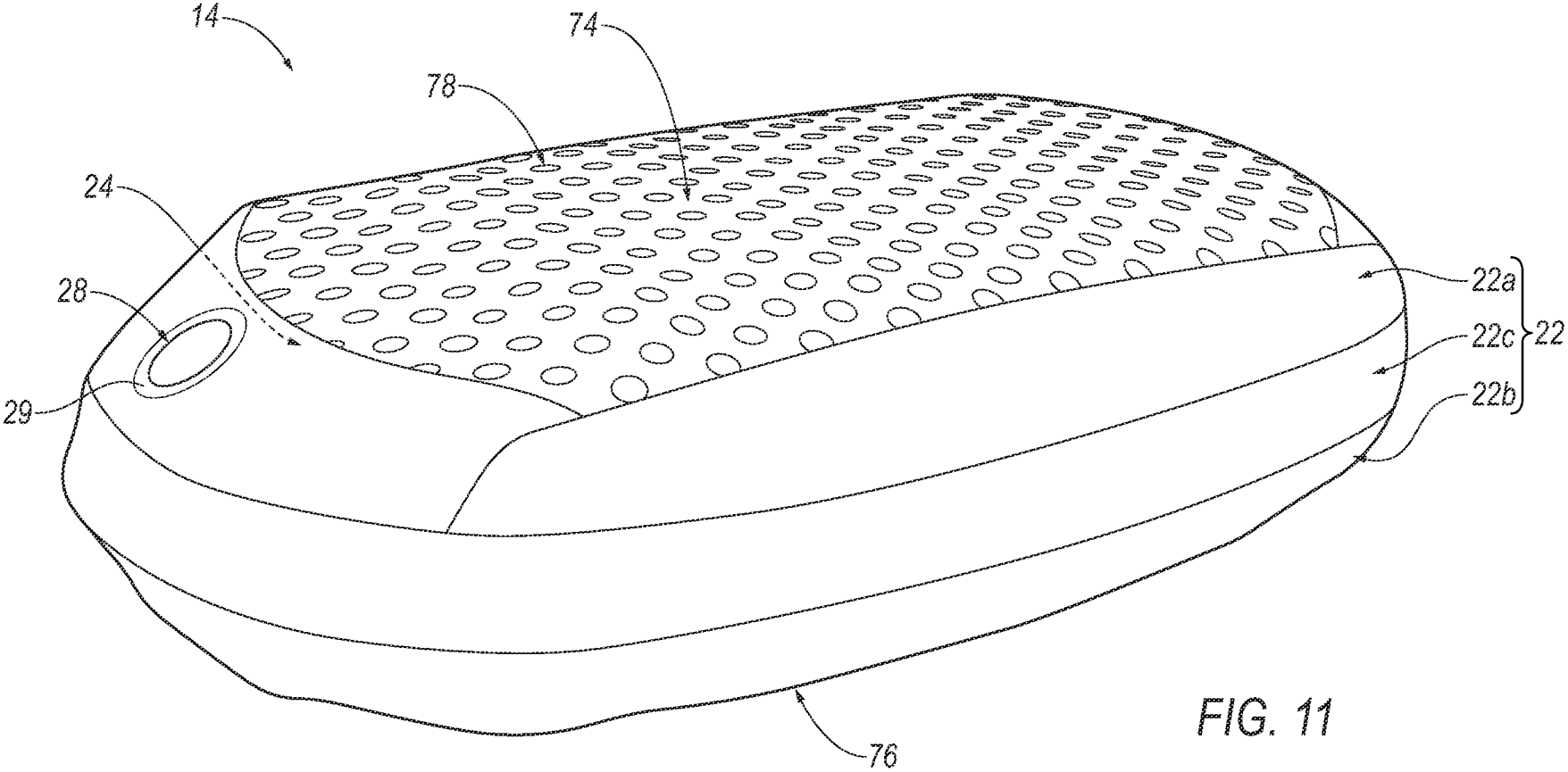
FIG. 11 is a perspective view of the outer casing portion of FIG. 1.
Figure 12:
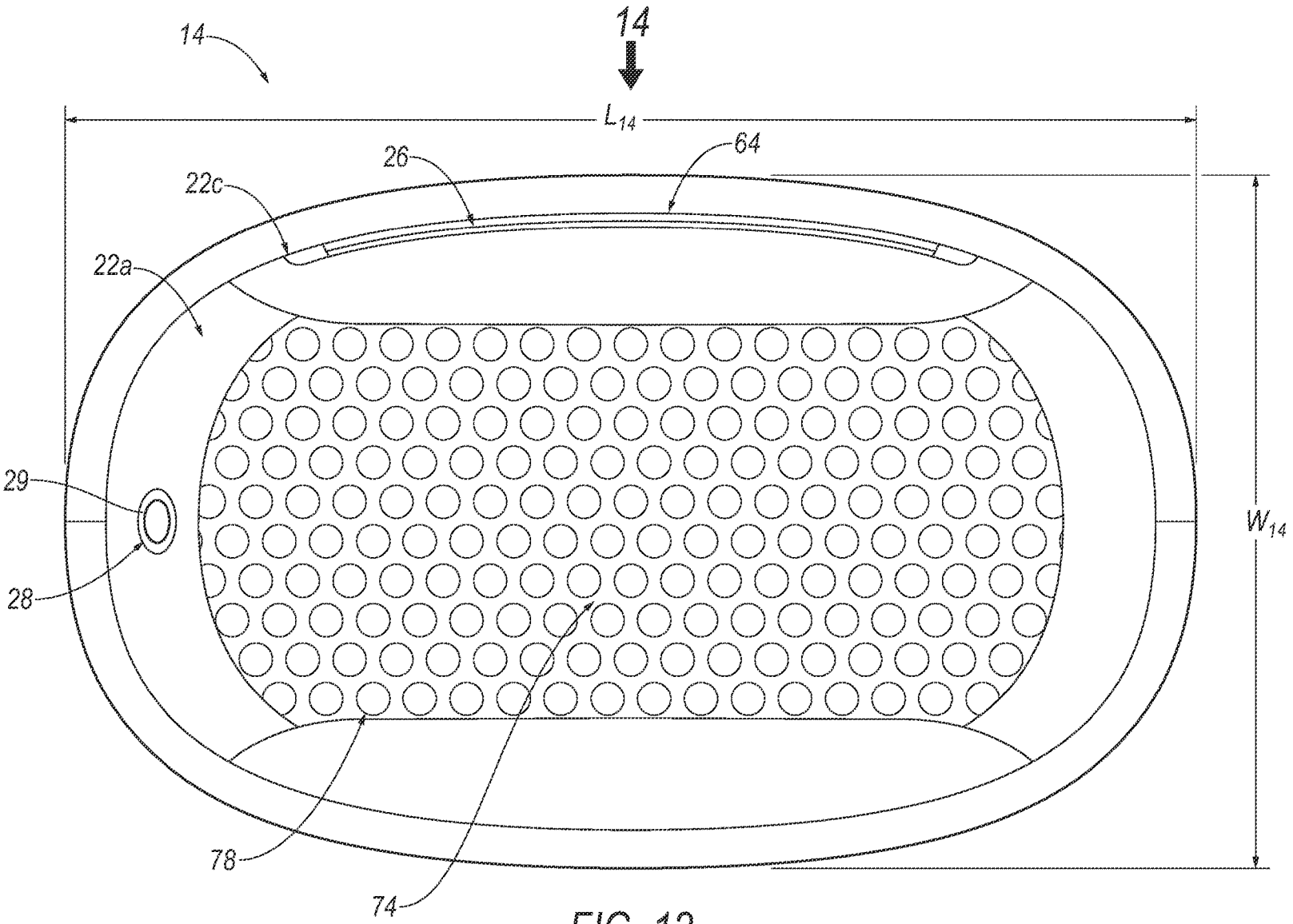
FIG. 12 is a top view of the outer casing portion of FIG. 11.

As described above, the body 22 of the outer casing portion 14 includes a first opening 26 (see, e.g., FIGS. 12 and 14) and a second opening 28 (see, e.g., FIGS. 11 and 12). While the second opening 28 is configured to permit the valve 16 of the inflatable portion 12 to pass there-through (as seen at, e.g., FIG. 2), the first opening 26 is configured to permit insertion of the body 18 of the inflatable portion 12 into the cavity 24 of the body 22 of the outer casing portion 14 (generally in a direction according to arrow in $D_{12\text{-}14}$ FIG. 1).

The body 22 may be formed from any desirable material that may be laundered, washed, disinfected, or the like. As will be explained in the following disclosure, the body 22 may be configured to be arranged in an expanded state that is substantially similar to, but larger than the inflatable portion 12 after the inflatable portion 12, which when arranged inside the cavity 24 of the body 22, is inflated for being arranged in an expanded state itself. However, in other instances, the body 22 of the outer casing portion 14 may be arranged in a substantially folded-flat, rolled or other compact state (not shown) when the inflatable portion 12, which may or may not be arranged in the cavity 24 of the body 22, is not arranged in the inflated state.

In some implementations, the body 22 may be formed from a lightweight denier material such as, for example, nylon or a ripstop nylon. In some instances, the body 22 may be formed from a lightweight denier material including a urethane coating such as, for example, a polyurethane coating or a thermoplastic polyurethane coating. In other examples, the body 22 may be formed from a combination of ripstop nylon material and a urethane coating such as, for example, a polyurethane coating or a thermoplastic polyurethane coating.

According to an exemplary method of assembling the assembly 10, in some implementations, the inflatable portion 12 may be initially arranged in a compact-and-deflated state whereby the body 18 of the inflatable portion 12 has not yet taken the shape of the upper dome portion 18*a*, the lower bowl portion 18*b*, and the substantially elliptically-shaped intermediate band portion 18*c* as seen and described above at FIGS. 3-10 (i.e., the inflatable portion 12 may be initially arranged in a substantially folded-flat, rolled or other compact state). Accordingly, when the inflatable portion 12 is initially arranged in the compact-and-deflated state, the inflatable portion 12 is inserted through the first opening 26 of the body 22 of the outer casing portion 14 (according to, e.g., the direction of the arrow $D_{12\text{-}14}$ in FIG. 1) such that the inflatable portion 12 is arranged within the cavity 24 of the body 22 of the outer casing portion 14.

Once arranged inside the cavity 24 of the body 22 of the outer casing portion 14, the valve 16 may be aligned with and pulled through the second opening 28 of the body 22 of the outer casing portion 14. The body 22 may also include a reinforcement ring 29 (see, e.g., FIGS. 11-12) circumscribing the second opening 28 in order to reduce wear of the body 22 if the valve 16 is successively pulled there-through and subsequently pushed there-through as a result of multiple assembling and disassembling processes imparted to the assembly 10. The reinforcement ring 29 may be made from a plastic material, a rubber material, or the like.

A user may then access the valve 16 in order to pressurize the fluid-receiving cavity 20 of the body 18 of the inflatable portion 12 with a pressurized fluid P while the inflatable portion 12 is arranged within the cavity 24 of the body 22 in a deflated state. In some instances, the valve 16 may be configured to be interfaced with an air pump (not shown) that provides the pressurized fluid P. In other examples, the valve 16 may be configured to permit a user to apply their lips to the valve 16 for manually depositing (i.e., "blowing up") the fluid-receiving cavity 20 of the body 18 of the inflatable portion 12 with air from the user's lungs. Accordingly, as the inflatable portion 12 is inflated with the pressurized fluid P, the outer casing portion 14 is shaped by the inflatable portion to an expanded state as seen, for example, at FIGS. 11 and 14. Conversely, when the user desires arrangement of one or both of the inflatable portion 12 and the outer casing portion 14 in a compact (i.e., deflated) state, the user arranges the valve 16 in an open state and applies an external force to the body 18 of the inflatable portion 12 for evacuating the pressurized fluid P from the cavity 20 of the body 18 of the inflatable portion 12.

With reference to FIGS. 11-14, the body 22 of the outer casing portion 14 may include a plurality of panel portions that may be secured (e.g., stitched) to one another. The plurality of panels defining the body 22 of the outer casing portion 14 may include: (1) a top panel configured to include a dome shape 22*a* (see, e.g., FIGS. 11, 12, and 14) that configures a portion of the cavity 24 of the outer casing portion 14 for containing the upper dome portion 18*a* of the inflatable portion 12; (2) a bottom panel configured to include a bowl shape 22*b* (see, e.g., FIGS. 11, 13, and 14) that configures another portion of the cavity 24 of the outer casing portion 14 for containing the lower bowl portion 18*b* of the inflatable portion 12; and (3) an intermediate panel configured to include a ring shape 22*c* (see, e.g., FIGS. 11, 12, and 14) that configures yet another portion of the cavity 24 of the outer casing portion 14 for containing the intermediate band portion 18*c* of the inflatable portion 12.

Figure 14:
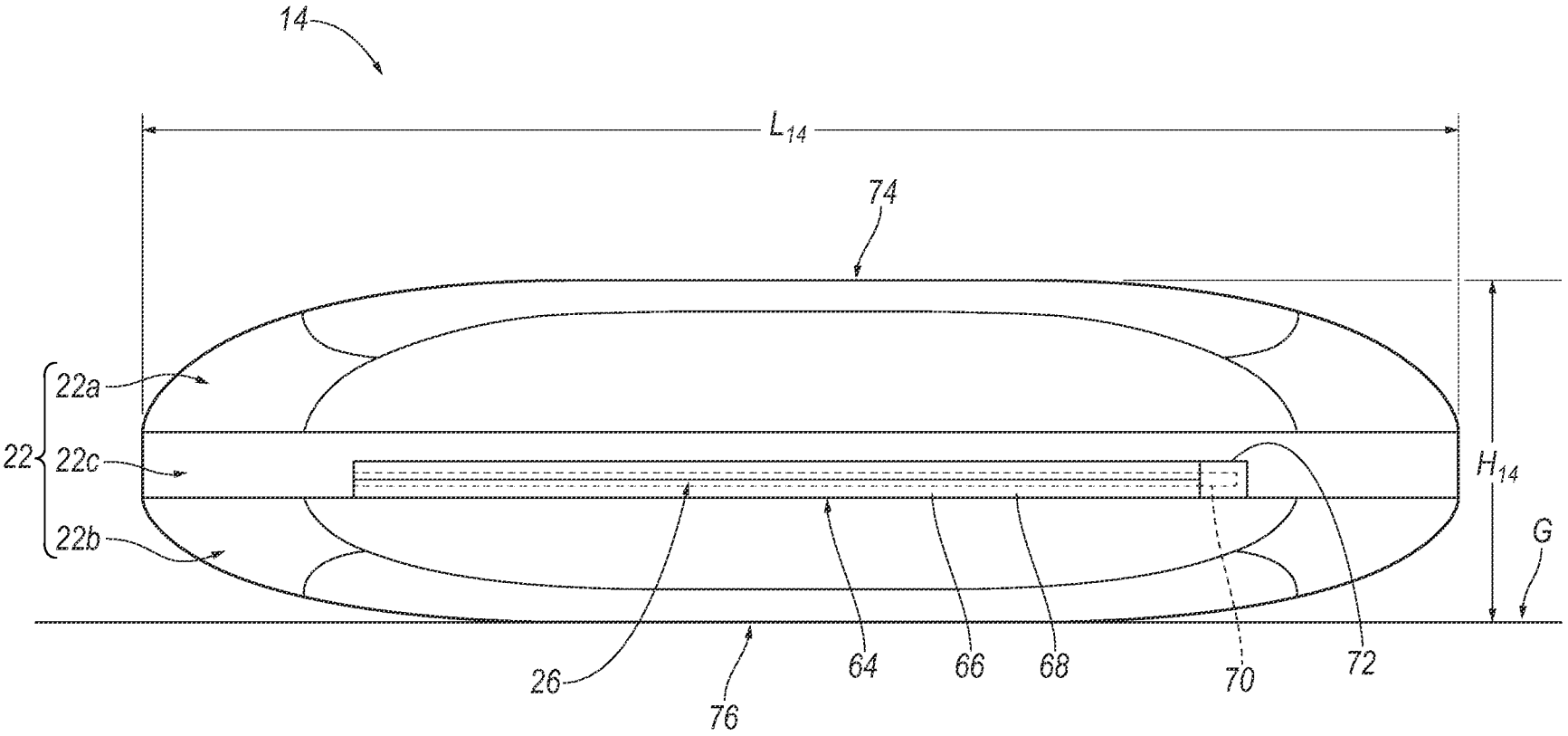
FIG. 14 is a side view of the outer casing portion according to arrow 14 of FIG. 12.

With reference to FIGS. 12 and 14, the intermediate panel configured to include the ring shape 22*c* of the body 22 of the outer casing portion 14 defines the first opening 26 of the body 22 of the outer casing portion 14. As seen at FIG. 14, the outer casing portion 14 may further include a closure element 64. The closure element 64 may be secured to the intermediate panel configured to include the ring shape 22*c* of the body 22. The closure element 64 extends across or over the first opening 26 in order to provide selective access to the cavity 24 of the outer casing portion 14. Although the first opening 26 may be formed by the intermediate panel configured to include the ring shape 22*c* of the body 22 of the outer casing portion 14, the first opening 26 may be formed by any panel of the outer casing portion 14 (e.g., the top panel configured to include the dome shape 22*a* or the bottom panel configured to include the bowl shape 22*b*); accordingly, the closure element 64 may be alternatively secured to either of the top panel configured to include the dome shape 22*a* or the bottom panel configured to include the bowl shape 22*b*.

In some implementations, the closure element 64 may include a zipper including a body of material 66 supporting cooperating teeth 68 that are selectively joined by a slider 70. In some examples, the body of material 66 of the closure element 64 may also include a docking bay or "garage" 72 for receiving the slider 70 when the closure element 64 seals or closes out the first opening 26. Although the closure element 64 is described above to include a zipper; other closure elements 64 may be utilized such as, for example, VELCRO®.

In some implementations, the top panel configured to include the dome shape 22*a* of the body 22 of the outer casing portion 14 may be sized to include a substantially flat top wall panel portion 74 (see, e.g., FIGS. 11, 12, and 14) that corresponds to a substantially similar size and shape of the substantially flat top wall portion 34 of the upper dome portion 18*a* of the inflatable portion 12. Furthermore, in other implementations, the bottom panel configured to include the bowl shape 22*b* of the body 22 of the outer casing portion 14 may be sized to include a substantially flat bottom wall panel portion 76 (see, e.g., FIGS. 11, 13, and 14) that corresponds to a substantially similar size and shape of the substantially flat bottom wall portion 38 of the lower bowl portion 18*b* of the inflatable portion 12.

Figure 13:
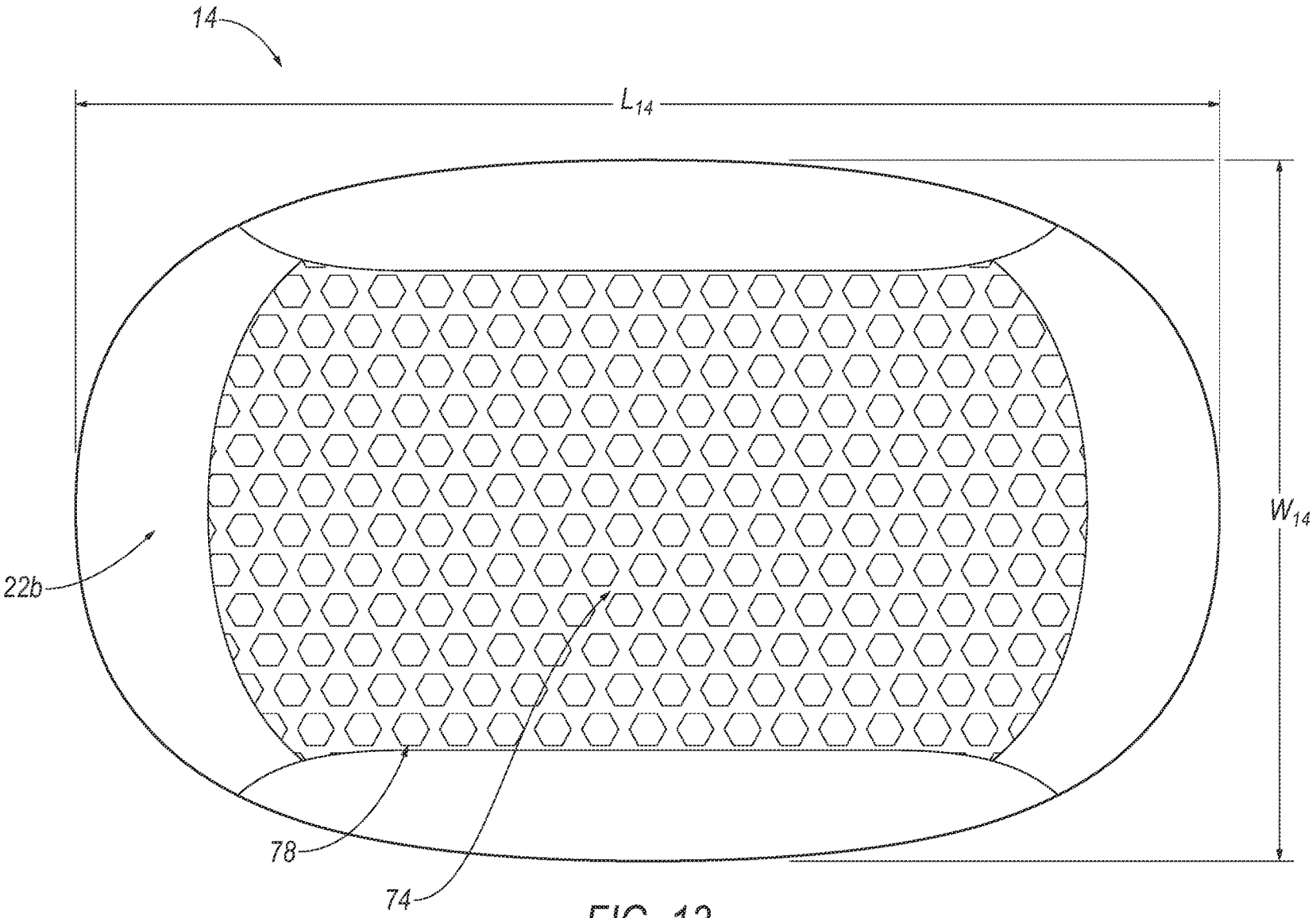
FIG. 13 is a bottom view of the outer casing portion of FIG. 11.

In some implementations, one or both of the substantially flat top wall panel portion 74 and the substantially flat bottom wall panel portion 76 may include a textured pattern 78 (see, e.g., FIGS. 11-13) that promotes friction when arranged adjacent, for example, one or both of, for example, a sole surface of a user's shoes (not shown), the underlying support surface or ground surface G (see, e.g., FIG. 14), or the like. In some examples, the textured pattern 78 may include the lightweight denier material defining one or both of the substantially flat top wall panel portion 74 and the substantially flat bottom wall panel portion 76 having a hashed or crisscross stitched pattern (not shown). In other examples, the textured pattern 78 may include the lightweight denier material defining one or both of the substantially flat top wall panel portion 74 and the substantially flat bottom wall panel portion 76 having a printed silicon gel pattern (e.g., an "array of circular dots" as seen at FIGS. 11-12, an "array of hexagons" as seen at FIG. 13, or any other desirable shape or size). In some configurations, the printed silicon gel pattern may include a "left foot print" (not shown) and a "right foot print" (not shown) in order to infer placement of a user's left foot and a user's right foot upon one or both of the substantially flat top wall panel portion 74 and the substantially flat bottom wall panel portion 76. Although the textured pattern 78 may include one or both of hashed or crisscross stitched pattern of the lightweight denier material and a printed silicon gel pattern, any desirable configuration promoting friction of the substantially flat top wall panel portion 74 and the substantially flat bottom wall panel portion 76 may be utilized.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to implementations disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the implementations that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An exercise assembly comprising:

a core bladder having a sealed body supporting a valve that permits fluid communication with a fluid-receiving cavity of the sealed body for selective arrangement of the sealed body in one of a compact deflated state or an expanded inflated state;

an outer case formed by a plurality of panels defining a core bladder receiving cavity that contains the core bladder; and wherein the outer case includes a first opening that cooperates with a closure element that provides selective access to the core bladder receiving cavity and a second opening that is sized for permitting access to the valve;

wherein the plurality of panels that form the outer case includes a top panel that is configured to include a dome-shape when the core bladder is arranged in the expanded inflated state; a bottom panel that is configured to include a bowl-shape when the core bladder is arranged in the expanded inflated state; and an intermediate ring-shaped panel connecting the dome-shaped panel to the bowl-shaped panel, wherein the intermediate ring-shaped panel defines the first opening that provides selective access to the core bladder receiving cavity, wherein one of the dome-shaped panel and the bowl-shaped panel defines the second opening that is sized for permitting access to the valve; and wherein one or both of the top panel and the lower panel includes a frictional, slip-resistant portion, wherein the frictional, slip-resistant portion further includes a silicon gel pattern arranged over a lightweight denier material.

2. The exercise assembly of claim 1, wherein the core bladder includes a skeletal load-support matrix disposed within the fluid-receiving cavity.

3. The exercise assembly of claim 2, wherein the core bladder is configured 10. to include:

a dome portion having a curved sidewall and a substantially flat top wall;

a bowl portion having a curved sidewall and a substantially flat bottom wall; and wherein a lower edge of the curved sidewall is connected to an upper edge of the curved sidewall of the bowl portion.

4. The exercise assembly of claim 3, wherein the skeletal load-support matrix includes a plurality of rib members extending between and connecting an inner surface of the substantially flat top wall and an inner surface of the substantially flat bottom wall.

5. The exercise assembly of claim 4, wherein the plurality of rib members include a first rib member, a second end rib member, and at least one intermediate rib member between the first rib member and the second rib member.

6. The exercise assembly of claim 1, wherein the closure element is attached to the intermediate ring-shaped panel and extends over the first opening.

7. The exercise assembly of claim 1, wherein the closure element includes a zipper including a body of material supporting cooperating teeth that are selectively joined by a slider.

8. The exercise assembly of claim 1, wherein the top panel includes a reinforcement ring circumscribing the second opening.

9. The exercise assembly of claim 1, wherein the lightweight denier material includes a urethane coating.

10. The exercise assembly of claim 9, wherein the lightweight denier material includes ripstop nylon, wherein the urethane coating includes polyurethane or thermoplastic polyurethane.

* * * * *